US009904221B2

(12) United States Patent
Tanaka et al.

(10) Patent No.: US 9,904,221 B2
(45) Date of Patent: Feb. 27, 2018

(54) PREHEATING DEVICE, FIXING SYSTEM, AND IMAGE FORMING APPARATUS

(71) Applicant: FUJI XEROX CO., LTD., Tokyo (JP)

(72) Inventors: Kei Tanaka, Kanagawa (JP); Kouichi Kimura, Kanagawa (JP); Mizuki Sugino, Kanagawa (JP); Mitsutoshi Hongo, Kanagawa (JP); Toshinori Sasaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/590,611

(22) Filed: May 9, 2017

(65) Prior Publication Data

US 2017/0357196 A1 Dec. 14, 2017

(30) Foreign Application Priority Data

Jun. 9, 2016 (JP) ..... 2016-115428
Jul. 21, 2016 (JP) ..... 2016-142971

(51) Int. Cl.

| | |
|---|---|
| ***G03G 15/20*** | (2006.01) |
| ***G03G 15/23*** | (2006.01) |
| *G03G 15/01* | (2006.01) |
| *F28F 5/02* | (2006.01) |
| *G03G 15/08* | (2006.01) |
| *G03G 15/16* | (2006.01) |
| *G03G 15/14* | (2006.01) |

(52) U.S. Cl.

CPC ..... *G03G 15/2064* (2013.01); *G03G 15/205* (2013.01); *G03G 15/237* (2013.01); *F28F 5/02* (2013.01); *G03G 15/01* (2013.01); *G03G 15/0105* (2013.01); *G03G 15/08* (2013.01); *G03G 15/14* (2013.01); *G03G 15/161* (2013.01); *G03G 15/20* (2013.01); *G03G 15/2053* (2013.01); *G03G 15/23* (2013.01); *G03G 15/231* (2013.01)

(58) Field of Classification Search

CPC ..... G03G 15/2064; G03G 15/205; G03G 15/237; G03G 15/01; G03G 15/0105; G03G 15/08; G03G 15/14; G03G 15/161; G03G 15/20; G03G 15/2053; G03G 15/23; G03G 15/231

USPC ..... 399/328

See application file for complete search history.

(56) References Cited

U.S. PATENT DOCUMENTS 5,071,504 A * 12/1991 Singer ..... B32B 37/00 100/314

FOREIGN PATENT DOCUMENTS

| | | |
|---|---|---|
| JP | 2006-219226 A | 8/2006 |
| JP | 2009-053288 A | 3/2009 |
| JP | 2013-167715 A | 8/2013 |

* cited by examiner

*Primary Examiner* — Susan Lee
(74) *Attorney, Agent, or Firm* — Sughrue Mion, PLLC

(57) ABSTRACT

A preheating device includes two first inverting members disposed at different positions while obliquely intersecting a feeding direction of a continuous recording medium on which an unfixed image is formed, the first inverting members inverting the recording medium by passing a back surface of the recording medium, on which the unfixed image is not formed, therealong before a fixing operation, and at least one heating rotating body disposed at a position further on an outside than a side edge portion of the recording medium in the feeding direction to preheat the recording medium before the fixing operation by passing a portion of the back surface of the recording medium present between the two first inverting members so that the portion of the back surface is wound around the heating rotating body.

6 Claims, 18 Drawing Sheets

PREHEATING DEVICE, FIXING SYSTEM, AND IMAGE FORMING APPARATUS

CROSS-REFERENCE TO RELATED APPLICATIONS

This application is based on and claims priority under 35 USC 119 from Japanese Patent Application No. 2016-115428 filed Jun. 9, 2016 and No. 2016-142971 filed Jul. 21, 2016.

BACKGROUND

(i) Technical Field

The present invention relates to a preheating device, a fixing system, and an image forming apparatus.

(ii) Related Art

In a known preheating device, before a continuous recording medium on which an unfixed image, such as a toner image, is formed is introduced into a fixing device, a back surface of the recording medium on which the unfixed image is not formed is preheated.

Besides, in a known turning bar device, when a web (continuous recording medium) constituted by a sheet material shaped like a long belt is transported, a transport state of the web is changed and adjusted by outputting the web in a state in which the web is wound around a turning bar disposed in a transport path.

SUMMARY

According to an aspect of the invention, there is provided a preheating device including two first inverting members disposed at different positions while obliquely intersecting a feeding direction of a continuous recording medium on which an unfixed image is formed, the first inverting members inverting the recording medium by passing a back surface of the recording medium, on which the unfixed image is not formed, therealong before a fixing operation, and at least one heating rotating body disposed at a position further on an outside than a side edge portion of the recording medium in the feeding direction to preheat the recording medium before the fixing operation by passing a portion of the back surface of the recording medium present between the two first inverting members so that the portion of the back surface is wound around the heating rotating body.

BRIEF DESCRIPTION OF THE DRAWINGS

Exemplary embodiments of the present invention will be described in detail based on the following figures, wherein.

DETAILED DESCRIPTION

Modes for carrying out the present invention (hereinafter referred to as "exemplary embodiments") will described below with reference to the drawings.

First Exemplary Embodiment

Figure 1:
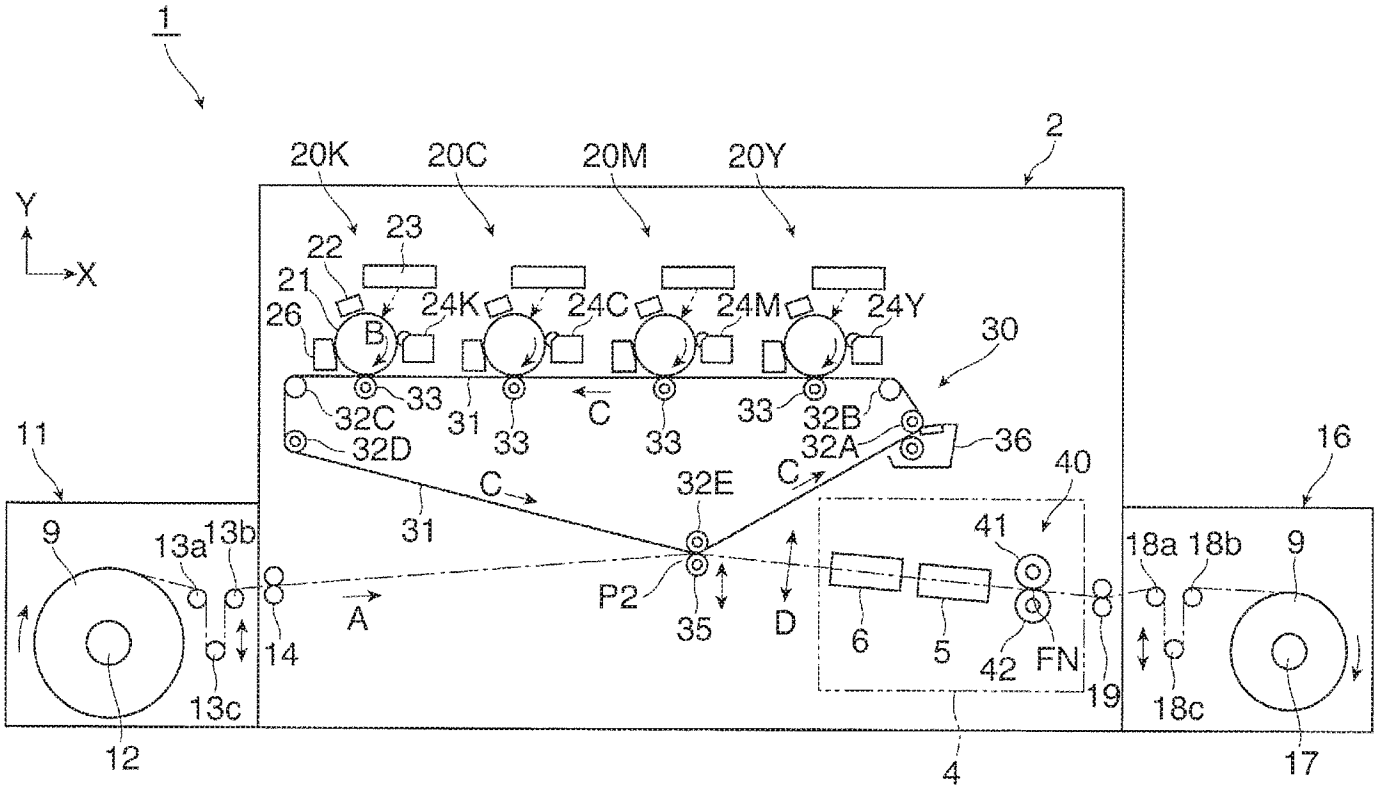
FIG. 1 is a schematic explanatory view illustrating a configuration of an image forming apparatus according to a first exemplary embodiment.
Figure 2:
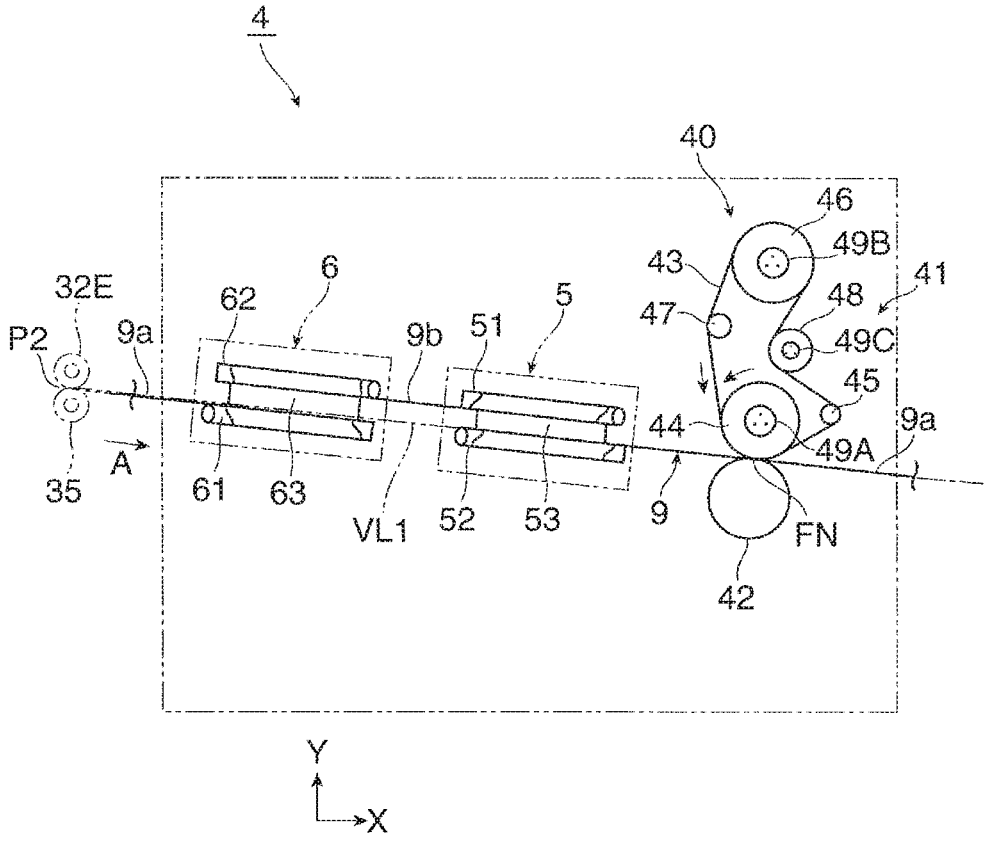
FIG. 2 is a schematic explanatory view illustrating a structure of a fixing system in the image forming apparatus illustrated in FIG. 1.
Figure 3:
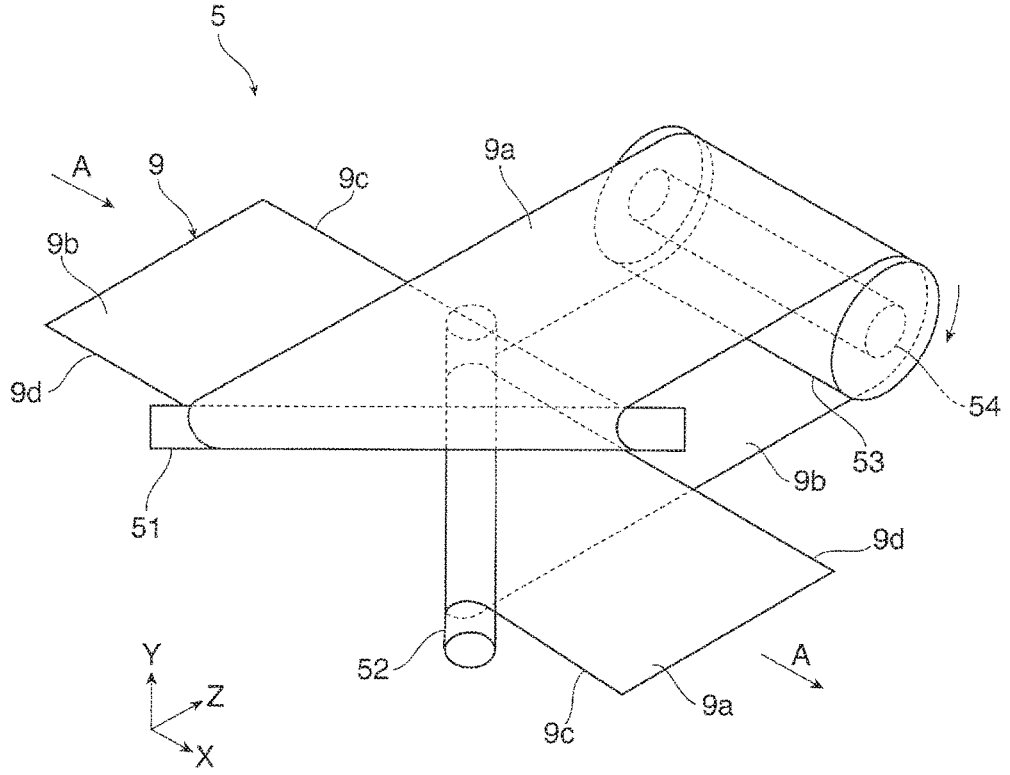
FIG. 3 is a schematic perspective view illustrating a structure of a preheating device in the fixing system illustrated in FIG. 2.

FIGS. 1 to 3 illustrate an image forming apparatus according to a first exemplary embodiment. FIG. 1 illustrates a general outline of the image forming apparatus, FIG. 2 illustrates a fixing system provided in the image forming apparatus, and FIG. 3 illustrates a preheating device provided in the image forming apparatus or the fixing system. In the figures including FIG. 1, arrows with signs X, Y, and Z denote (the directions of) orthogonal coordinate axes representing the directions of width, height, and depth, respectively, of a three-dimensional space assumed in the figures.

[Overall Configuration of Image Forming Apparatus]

An image forming apparatus 1 according to the first exemplary embodiment forms an image made with toner of developer on continuous paper 9 serving as an example of a continuous recording medium wound in a roll form.

As schematically illustrated in FIG. 1, the image forming apparatus 1 includes a supply device 11 that supplies continuous paper 9, an image forming device 2 that forms a toner image serving as an example of an unfixed image on the continuous paper 9 supplied from the supply device 11, a fixing system 4 that performs a fixing operation of fixing the toner image formed on the continuous paper 9 in the image forming device 2 after preheating, before the fixing operation, a back surface 9*b* of the continuous paper 9 on which the toner image is not formed, and a storage device 16 that stores the continuous paper 9 after an image is formed thereon by the fixing operation in the fixing system 4.

The supply device 11 includes a pay-out roller 12 that pays out the continuous paper 9 wound in a roll form, an adjusting mechanism 13 that adjust a pay-out operation of the pay-out roller 12, and an introduction transport roller pair 14 that transports the continuous paper 9 paid out through the adjusting mechanism 13 and supplies the continuous paper 9 to the image forming device 2.

The pay-out roller 12 is rotated in a pay-out direction by driving force received from an unillustrated driving device. The adjusting mechanism 13 includes two transport rollers 13*a* and 13*b* arranged in parallel and spaced from each other in a transport direction (feeding direction) A of the continuous paper 9, an elevating roller 13*c* that moves up and down almost along the gravitational direction between the two transport rollers 13*a* and 13*b*, and an unillustrated position sensor that detects that the elevating roller 13*c* reaches specified positions in the up-down direction. In the adjusting mechanism 13, the continuous paper 9 is supported while being laid between the two transport rollers 13*a* and 13*b*, and is transported in such a manner that the continuous paper 9 is pulled downward almost along the gravitational direction by the elevating roller 13*c* between the transport rollers 13*a* and 13*b* and then turns back.

The transport roller pair 14 is constituted of a rotating roller and a driven roller arranged in pressure contact with each other. The rotating roller is rotated in a direction corresponding to the transport direction A by driving force received from an unillustrated driving device, and the continuous paper 9 is thereby transported while passing through a pressure contact portion between these rollers. In practice, the transport roller pair 14 is disposed in the image forming device 2.

In the supply device 11, the continuous paper 9 is transported by the transport roller pair 14 when the pay-out roller 12 is stopped and the elevating roller 13*c* of the adjusting mechanism 13 is moved to the lower specified position.

On the other hand, when the continuous paper 9 is transported by the transport roller pair 14, the elevating roller 13*c* starts moving up, and moves up to finally reach the upper specified position. In this stage, the pay-out roller 12 rotates to pay out the continuous paper 9. When the continuous paper 9 is paid out from the pay-out roller 12, the elevating roller 13*c* starts moving down, and moves down to finally reach the lower specified position. In this stage, the pay-out roller 12 is stopped to discontinue paying-out of the continuous paper 9. The amount of continuous paper 9 supplied to the image forming device 2 corresponds to the rotation amount of the transport roller pair 14.

As the continuous paper 9, for example, a belt-shaped long continuous material made of paper such as high-quality paper or glassine paper, or synthetic resin, such as polypropylene, is used. Besides, for example, label paper having a structure in which a surface base material (image forming surface) is provided on release paper with an adhesive layer interposed between is also used as the continuous paper 9.

The storage device 16 includes a take-up roller 17 that takes up the continuous paper 9 on which an image is formed, an adjusting mechanism 18 that adjusts a take-up operation of the take-up roller 17, and an output transport roller pair 19 that transports the continuous paper 9 to the adjusting mechanism 18 after the image is formed on the continuous paper 9.

The take-up roller 17 is rotated in a take-up direction by driving force received from an unillustrated driving device. The adjusting mechanism 18 is constituted of two transport rollers 18*a* and 18*b*, an elevating roller 18*c*, and a detector that detects upper and lower specified positions of the elevating roller 18*c*, almost similarly to the adjusting mechanism 13 in the supply device 11. The transport roller pair 19 has a structure almost similar to the transport roller pair 14 in the supply device 11. In practice, the transport roller pair 19 is also disposed in the image forming device 2, similarly to the transport roller pair 14.

The image forming device 2 forms toner images by using some or all of toners of four colors of yellow (Y), magenta (M), cyan (C), and black (K) on the basis of image information input from the outside through various units, and transfers the toner images on the continuous paper 9.

In the first exemplary embodiment, the image forming device 2 includes four image forming units 20Y, 20M, 20C, and 20K each of which forms a toner image of any one of the above four colors (Y, M, C, and K), and an intermediate transfer device 30 that holds color toner images formed by the image forming units 20 (Y, M, C, and K) and transports the color toner images to a second transfer position P2 where the color toner images are finally transferred onto the continuous paper 9.

Each of the image forming units 20 (Y, M, C, and K) includes a photoconductor drum 21 to be rotated in a predetermined direction (a direction shown by arrow B). Also, in each of the image forming units 20 (Y, M, C, and K), a charging device 22, an exposure device 23, a developing device 24, and a cleaning device 26 are arranged around the photoconductor drum 21. The charging device 22 charges a peripheral surface of the photoconductor drum 21. The exposure device 23 forms an electrostatic latent image by exposing the charged peripheral surface of the photoconductor drum 21 to light based on the image information. The developing device 24 develops the electrostatic latent image formed on the peripheral surface of the photoconductor drum 21 with toner of developer to form a toner image. The cleaning device 26 removes and cleans off unwanted matter, such as toner, remaining on the peripheral surface of the photoconductor drum 21.

The developing device 24 is provided as four developing devices 24Y, 24M, 24C, and 24K. Each of the developing devices 24Y, 24M, 24C, and 24K stores toner of any one of the above four colors (Y, M, C, and K), and develops an electrostatic latent image of the corresponding color with the toner.

The intermediate transfer device 30 is disposed below the four image forming units 20 (Y, M, C, and K).

In the first exemplary embodiment, the intermediate transfer device 30 includes an intermediate transfer belt 31 that rotates in a direction of arrow C while passing through first transfer positions at photoconductor drums 21 in the image forming units 20 (Y, M, C, and K), plural support rollers 32A to 32E that support the intermediate transfer belt 31 rotatably, and first transfer devices 33 that first-transfer toner images on the photoconductor drums 21 onto an outer surface of the intermediate transfer belt 31 by, for example, an electrostatic action by pressing the outer surface of the intermediate transfer belt 31 against the first transfer positions on the photoconductor drums 21 in the image forming units 20 (Y, M, C, and K). For example, the first transfer devices 33 are each shaped like a roller. The intermediate transfer device 30 further includes a second transfer device 35 shaped like, for example, a roller to second-transfer the toner images on the intermediate transfer belt 31 onto continuous paper 9 by, for example, an electrostatic action, and a cleaning device 36 that removes and cleans off unwanted matter, such as toner, remaining on the outer surface of the intermediate transfer belt 31.

The support roller 32A, the support roller 32D, and the support roller 32E are respectively structured as a driving roller, a tensioning roller, and a second-transfer backup roller. The second transfer device 35 is displaceable to move into contact with and apart from the intermediate transfer belt 31 supported by the second-transfer backup roller 32E. Thus, for example, the second transfer device 35 moves to a position in contact with the intermediate transfer belt 31 only during a period in which a second transfer operation is performed, and moves to a position separate from the intermediate transfer belt 31 during other necessary periods.

The first transfer positions are positions where the photoconductor drums 21 are opposed to the first transfer devices 33 in the image forming units 20 (strictly, positions where the photoconductor drums 21 are in contact with the intermediate transfer belt 31). The second transfer position P2 is a position where the intermediate transfer belt 31 is in opposed contact with the second transfer device 35 in the intermediate transfer device 30.

[Structure of Fixing System]

As illustrated in, for example, FIGS. 1 and 2, the fixing system 4 includes a fixing device 40 that performs a fixing operation of fixing a toner image formed as an unfixed image on continuous paper 9 by passing the continuous paper 9 therethrough, and a preheating device 5 disposed at a position upstream of the fixing device 40 in the feeding direction A of the continuous paper 9 to preheat, before the fixing operation, a back surface 9*b* of the continuous paper 9 on which the toner image is not formed.

The fixing system 4 is disposed between (the second transfer position P2 in) the image forming device 2 and the storage device 16. The fixing device 40 in the fixing system 4 includes at least a heating rotating body 41 and a pressurizing rotating body 42, as illustrated in FIG. 1. A two-dot chain line VL1 in FIG. 2 is an imaginary straight line that connects the second transfer position P2 in the image forming device 2 and a fixing nip FN (to be described later) serving as a fixing portion in the fixing device 40 in the shortest distance.

As illustrated in FIG. 2, the fixing device 40 of the first exemplary embodiment adopts a belt-shaped heating rotating body 41 and a roller-shaped pressurizing rotating body (pressurizing roller) 42. The belt-shaped heating rotating body 41 is constituted of an endless heating belt 43 serving as a heating member, a fixing roller 44 serving as a pressing member, a first support roller 45, an inner heating roller 46, and a second support roller 47, which are disposed to support the heating belt 43 while being in contact with an inner peripheral surface of the heating belt 43, and an outer heating roller 48 in contact with a portion of an outer peripheral surface of the heating belt 43 between the first support roller 45 and the inner heating roller 46 to press the portion toward the inner peripheral surface of the heating belt 43.

In the fixing device 40, the heating belt 43 of the heating rotating body 41 is in pressure contact with the pressurizing roller 42 at a portion of the heating belt 43 wound on an outer peripheral surface of the fixing roller 44. Thus, the pressure contact portion between the heating belt 43 and the pressurizing roller 42 serves as a fixing nip FN for fixing the unfixed toner image formed on the continuous paper 9 by heating and pressurization.

The heating belt 43 is composed of a belt base made of, for example, polyimide resin or polyamide resin, an elastic layer stacked on an outer peripheral surface of the belt base and made of, for example, silicone rubber, and a release layer stacked on a surface of the elastic layer and made of, for example, a tetrafluoroethylene perfluoroalkyl vinylether copolymer (PFA).

The fixing roller 44 is constituted by a cylindrical member made of metal such as aluminum or stainless steel, and is rotated in a direction of arrow in FIG. 2 by an unillustrated driving unit. A heat source 49A, such as a halogen lamp, is disposed inside the fixing roller 44, and heats the fixing roller 44 so that the surface temperature of the fixing roller 44 reaches a required temperature.

Almost similarly to the fixing roller 44, the inner heating roller 46 is constituted by a cylindrical member made of metal such as aluminum or stainless steel. A heat source 49B, such as a halogen lamp, is disposed inside the inner heating roller 46, and heats the inner heating roller 46 so that the surface temperature of the inner heating roller 46 reaches a required temperature. Also, force is applied from an unillustrated elastic member, such as a spring, to the inner heating roller 46 so that the inner heating roller 46 is elastically displaceable from the inner side toward the outer side of the heating belt 43, and this applies a required tension to the heating belt 43.

Almost similarly to the fixing roller 44, the outer heating roller 48 is constituted by a cylindrical member made of metal such as aluminum or stainless steel. A heat source 49C, such as a halogen lamp, is disposed inside the outer heating roller 48, and heats the outer heating roller 48 so that the surface temperature of the outer heating roller 48 reaches a required temperature.

The heating belt 43 stretched between the plural rollers is heated from the inner peripheral surface side and the outer peripheral surface side by the fixing roller 44, the outer heating roller 48, and the inner heating roller 46 while circularly rotating. The heating belt 43 is thereby heated so that the temperature of the outer peripheral surface thereof reaches a required temperature.

The pressurizing roller 42 is constituted of a cylindrical roller base made of metal such as aluminum or stainless steel, an elastic layer stacked on an outer surface of the roller base and made of, for example, silicone rubber, and a release layer stacked on a surface of the elastic layer and made of, for example, PFA.

[Structure of Preheating Device]

As illustrated in, for example, FIGS. 2 and 3, the preheating device 5 includes two first inverting members 51 and 52 and a heating roller 53 serving as an example of a heating rotating body. The two first inverting members 51 and 52 are disposed at different positions to obliquely intersect the feeding direction A of the continuous paper 9 on which the toner image is formed, and invert the continuous paper 9 by passing a back surface 9*b* of the continuous paper 9, on which the toner image is not formed, therealong before the fixing operation. The heating roller 53 is disposed at a position further on an outside than side edge portions 9*c* and 9*d* of the continuous paper 9 in the feeding direction A, and preheats a portion of the back surface 9*b* of the continuous paper 9 located between the first inverting members 51 and 52 before the fixing operation by passing the portion of the back surface 9*b* along the heating roller 53 so that the portion of the back surface 9*b* is wound around the heating roller 53.

For example, the two first inverting members 51 and 52 are cylindrical members made of metal. The upstream-side first inverting member 51 disposed on the upstream side in the feeding direction A of the continuous paper 9 inverts the continuous paper 9 transported to the first inverting member 51 so that the continuous paper 9 is transported with the back surface 9*b* being in contact with the outer peripheral surface of the heating roller 53. The downstream-side first inverting member 52 disposed on the downstream side in the feeding direction A of the continuous paper 9 inverts the continuous paper 9 transported from the heating roller 53 to the first inverting member 52 so that the continuous paper 9 is transported with a front surface 9*a* being opposed to the heating rotating body 41 (heating belt 43) in the fixing device 40.

The first inverting members 51 and 52 in the first exemplary embodiment are fixedly arranged to intersect the feeding direction A of the continuous paper 9 at an angle of 45 degrees.

Specifically, the upstream-side first inverting member 51 is disposed at a position on a relatively upper side of the downstream-side first inverting member 52 while intersecting the downstream-side first inverting member 52. The upstream-side first inverting member 51 is used to introduce the continuous paper 9 sent in the preheating device 5 from the lower side thereof and to pass the continuous paper 9 on the upper side thereof.

The downstream-side first inverting member 52 is disposed at a position on a relatively lower side of the upstream-side first inverting member 51 to substantially orthogonally intersect the upstream-side first inverting member 51. The downstream-side first inverting member 52 is used to introduce the continuous paper 9 sent from the heating roller 53 from the lower side thereof and to pass the continuous paper 9 on the upper side thereof.

Alternatively, for example, the first inverting members 51 and 52 may be shaped like a barrel as a whole and be curved with an arc-shaped cross section only in a portion to be in contact with the continuous paper 9. The shapes of other inverting members to be described later are similar to the shape of the first inverting members 51 and 52.

Figure 5:
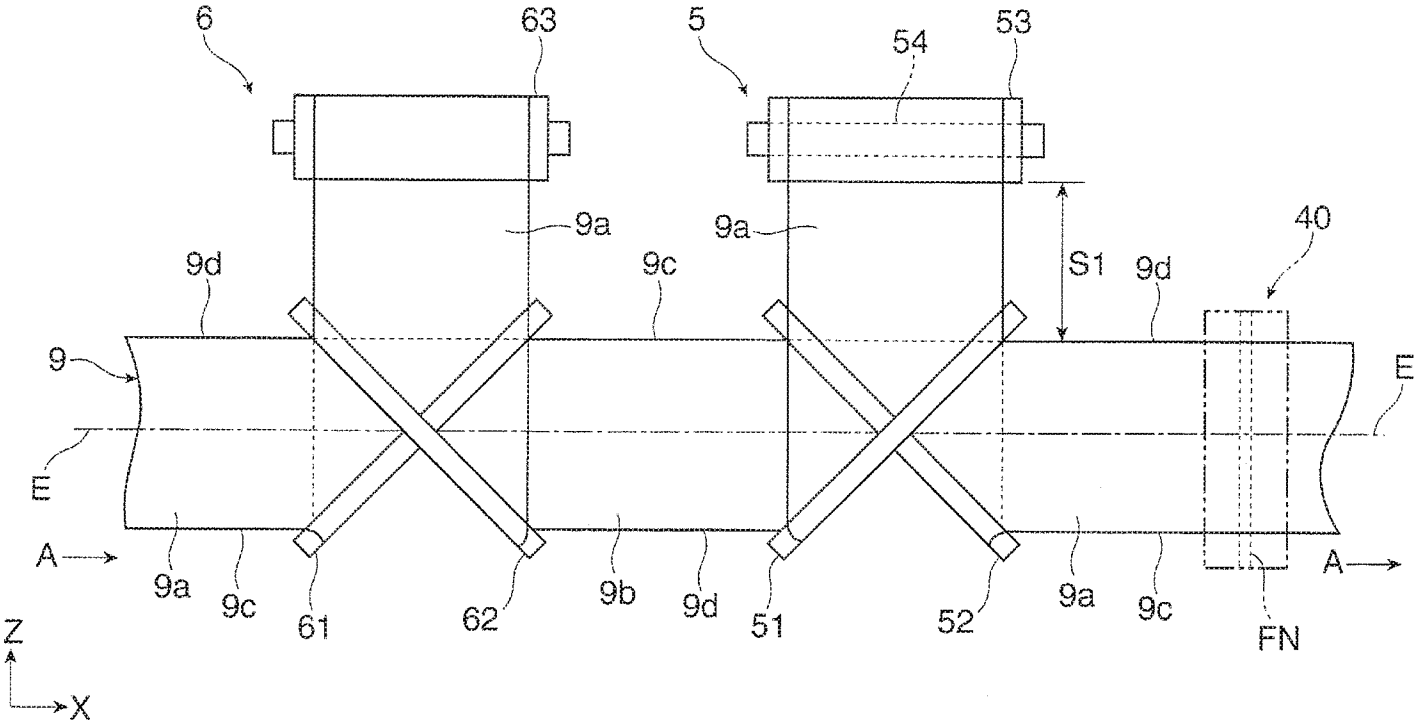
FIG. 5 is a schematic explanatory view illustrating a state of the fixing system of FIG. 2 when viewed from above.

As illustrated in FIGS. 3 and 5, the heating roller 53 is disposed at a position spaced outward by a predetermined distance S1 from one of the side edge portions 9*c* and 9*d* of the continuous paper 9 in the feeding direction A (the side edge portion 9*d* in the first exemplary embodiment) in a state in which the axial direction of the heating roller 53 is substantially parallel to the feeding direction A of the continuous paper 9.

The heating roller 53 is constituted of a cylindrical roller base made of, for example, metal, and a heat source 54, such as a halogen lamp, disposed in an internal space of the roller base. The roller base of the heating roller 53 is rotatably provided, and is driven to rotate along with the motion (transport movement) of the continuous paper 9 that passes while being wound around the heating roller 53. In the first exemplary embodiment, the winding angle of the back surface 9*b* of the continuous paper 9 around the heating roller 53 is set to be 180 degrees or more, for example, from the viewpoint of reliably heating the back surface 9*b* of the continuous paper 9.

However, even when the winding angle of the back surface 9*b* of the continuous paper 9 around the heating roller 53 is 90 degrees or more, this winding angle is more effective than when the winding angle is less than 90 degrees. That is, the winding angle less than 90 degrees is disadvantageous, for example, from the viewpoints of ensuring the heating length and restricting the installation space of the preheating device 5 from being increased by the difficulty in arranging the first inverting members 51 and 52 in a state in which the winding angle of the continuous paper 9 increases to an obtuse angle before and after winding around the heating roller 53. This condition concerning the winding angle also applies to a heating rotating body such as a heating roller 57 to be described later.

A one-dot chain line E in, for example, FIG. 5 shows almost the center position (center line) in the width direction of the continuous paper 9 that is being transported in the feeding direction A.

As illustrated in FIGS. 1 and 2, in the fixing system 4, it is necessary to feed out the continuous paper 9 from the preheating device 5 to the fixing device 40 after inverting the continuous paper 9 so that the front surface 9*a* on which the toner image is formed, of the front and back surfaces, faces up. Hence, an inverting device 6 is disposed upstream of the preheating device 5 in the feeding direction A of the continuous paper 9.

Figure 4:
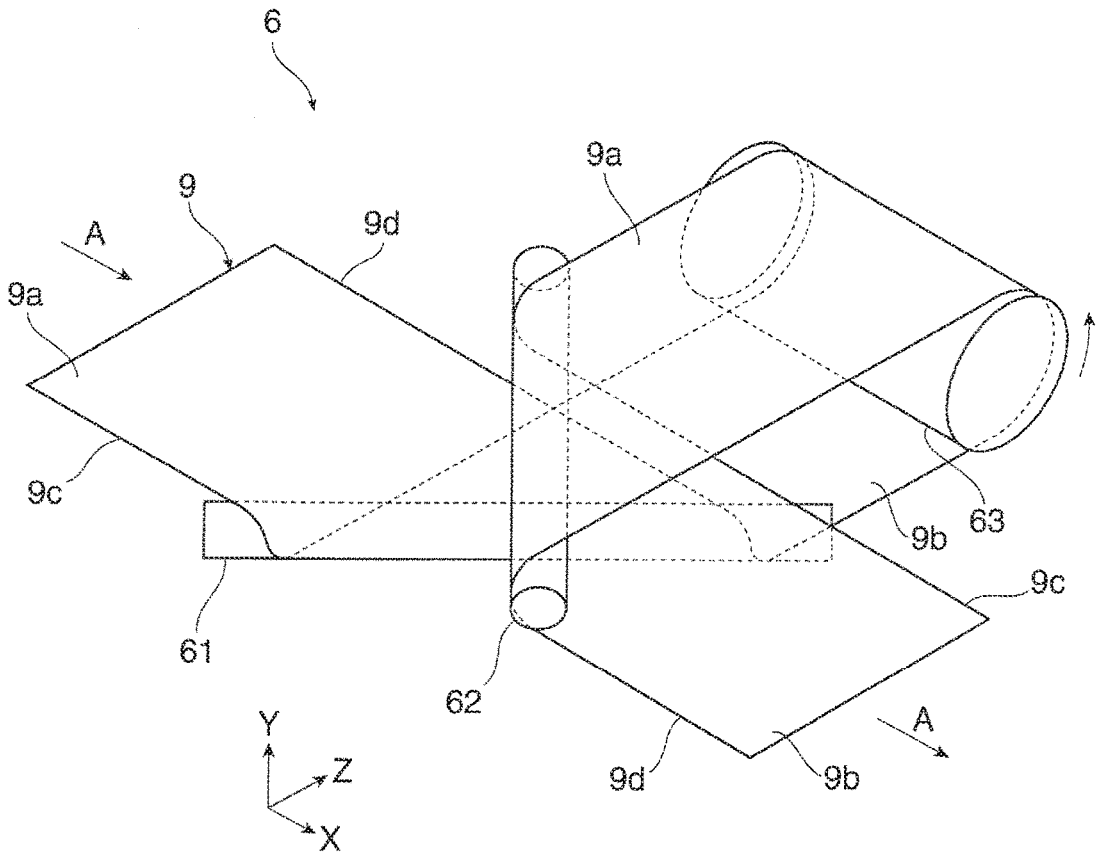
FIG. 4 is a schematic perspective view illustrating a structure of an inverting device in the fixing system illustrated in FIG. 2.

As illustrated in, for example, FIGS. 2 and 4, the inverting device 6 includes two second inverting members 61 and 62 and a relay roller 63 serving as an example of a relay rotating body. The second inverting members 61 and 62 are disposed at different positions further on the front side serving as the upstream side than the upstream-side first inverting member 51 of the preheating device 5 in the feeding direction A of the continuous paper 9 while obliquely intersecting the feeding direction A of the continuous paper 9. The second inverting members 61 and 62 invert the continuous paper 9 by passing the back surface 9*b* of the continuous paper 9 therealong. The relay roller 63 is disposed at a position further on the outside than the side edge portions 9*c* and 9*d* of the continuous paper 9 in the feeding direction A, and passes a portion of the back surface 9*b* of the continuous paper 9 located between the second inverting members 61 and 62 so that the portion of the back surface 9*b* is wound around the relay roller 63.

For example, the two second inverting members 61 and 62 are cylindrical members made of metal. The upstream-side second inverting member 61 disposed on the upstream side in the feeding direction A of the continuous paper 9 inverts the continuous paper 9 transported to the second inverting member 61 to transport the continuous paper 9 in a state in which the back surface 9*b* of the continuous paper 9 is in contact with an outer peripheral surface of the relay roller 63. The downstream-side second inverting member 62 disposed on the downstream side in the feeding direction A of the continuous paper 9 inverts the continuous paper 9 transported from the relay roller 63 to the second inverting member 62 to transport the continuous paper 9 so that the front and back surfaces of the continuous paper 9 face in directions opposite from the directions when the continuous paper 9 is transported to the upstream-side second inverting member 61. In the first exemplary embodiment, the second inverting member 62 inverts the continuous paper 9 so that the back surface 9*b* of the continuous paper 9 faces up.

In the first exemplary embodiment, the second inverting members 61 and 62 are fixedly arranged to intersect the feeding direction A of the continuous paper 9 at an angle of 45 degrees.

Specifically, the upstream-side second inverting member 61 is disposed at a position on a relatively lower side of the downstream-side second inverting member 62 while intersecting the downstream-side second inverting member 62. The upstream-side second inverting member 61 is used to introduce the continuous paper 9 transported through the second transfer position P2 in the image forming device 2 from the upper side of the second inverting member 61 and to pass the continuous paper 9 on the lower side thereof.

The downstream-side second inverting member 62 is disposed at a position on a relatively upper side of the upstream-side second inverting member 61 while substantially orthogonally intersecting the upstream-side second inverting member 61. The downstream-side second inverting member 62 is used to introduce the continuous paper 9 sent from the relay roller 63 from the upper side of the second inverting member 62 and to pass the continuous paper 9 on the lower side thereof.

As illustrated in FIGS. 4 and 5, the relay roller 63 is disposed at a position spaced outward by a predetermined distance from one of the side edge portions 9*c* and 9*d* of the continuous paper 9 in the feeding direction A in a state in which the axial direction of the relay roller 63 is substantially parallel to the feeding direction A of the continuous paper 9.

The relay roller 63 is constituted by a cylindrical roller base made of, for example, metal. The relay roller 63 is rotatable, and is driven to rotate along with the motion (transport movement) of the continuous paper 9 that passes while being wound around the relay roller 63.

[Image Forming Operation (Including Preheating and Fixing)]

Next, an image forming operation of the image forming apparatus 1 including the preheating device 5 and so on will be described. Here, a description will be given of a case in which a multicolor (full-color) image is formed by combining toners of the above four colors (Y, M, C, and K).

First, a toner image is formed as an unfixed image and is transferred onto continuous paper 9 in the image forming device 2.

As illustrated in FIG. 1, in each of the image forming units 20 (Y, M, C, and K), after the peripheral surface of the rotating photoconductor drum 21 is charged to a required polarity and a required potential by the charging device 22, the charged peripheral surface is exposed by the exposure device 23 on the basis of a color component obtained from (multicolor) image information, so that an electrostatic latent image of the color component is formed. After that, the electrostatic latent image is developed with charged toner of the corresponding color by the developing device 24 (Y, M, C, or K), and is thereby visualized as a color toner image.

Next, color toner images formed on the photoconductor drums 21 in the respective image forming units 20 (Y, M, C, and K) are first-transferred in order onto the rotating intermediate transfer belt 31 of the intermediate transfer device 30 by the transfer action of the first transfer devices 33, and are then transported to the second transfer position P2.

Finally, the toner images first-transferred on the intermediate transfer belt 31 are collectively second-transferred onto continuous paper 9 transported to the second transfer position P2 by the transfer action of the second transfer device 35.

The continuous paper 9 paid out from the supply device 11 is transported by the transport roller pair 14 toward the second transfer position P2 in operative association with the toner-image forming operation in the image forming device 2. At this time, in the supply device 11, when the continuous paper 9 is transported by the transport roller pair 14, the elevating roller 13*c* in the adjusting mechanism 13 starts moving up from the lower specified position, and moves up to finally reach the upper specified position, as described above. In this stage, the pay-out roller 12 rotates to pay out the continuous paper 9. For example, the continuous paper 9 is continuously transported during the toner-image forming operation.

Next, the continuous paper 9 on which the toner image has been formed is sent out from the second transfer position P2, is transported toward the fixing system 4, and is subjected to preheating and fixing of the toner image in the fixing system 4.

As illustrated in FIGS. 1 and 2, in the fixing system 4, the continuous paper 9 sent out from the second transfer position P2 is transported to pass through the inverting device 6, the preheating device 5, and the fixing device 40 in this order.

First, as illustrated in FIGS. 4 and 5, the continuous paper 9 is sent into the inverting device 6 in a state in which the front surface 9*a* having the toner image formed thereon faces up. Then, the continuous paper 9 is inverted, and is sent out from the inverting device 6 with the back surface 9*b* facing up.

At this time, in the inverting device 6, the continuous paper 9 passes while the back surface 9*b* is in contact with the surface of the upstream-side second inverting member 61 to be obliquely wound around the surface. The continuous paper 9 is thereby twisted 90 degrees and is inverted. In this state, the continuous paper 9 is sent out toward the relay roller 63. After that, the continuous paper 9 is transported along with the rotation of the relay roller 63 while the back surface 9*b* is in contact with the relay roller 63 to be wound around the relay roller 63 from the lower side. Then, the continuous paper 9 is sent out to return to the downstream-side second inverting member 62. Finally, the continuous paper 9 passes while the back surface 9*b* is in contact with the surface of the downstream-side second inverting member 62 to be obliquely wound around the surface. The continuous paper 9 is thereby twisted 90 degrees, and is inverted. In this state, the continuous paper 9 is sent out from the inverting device 6 with the back surface 9*b* facing up. After that, the continuous paper 9 is transported toward the preheating device 5 provided on the downstream side.

Subsequently, as illustrated in FIGS. 3 and 5, the continuous paper 9 inverted in the inverting device 6 is sent into the preheating device 5 in the state where the back surface 9*b* having no tone image faces up, and is preheated from the back surface 9*b* before the fixing operation. Also, the continuous paper 9 is inverted, and is sent out from the preheating device 5 with the front surface 9*a* facing up.

At this time, in the preheating device 5, the continuous paper 9 is passed while the back surface 9*b* is in contact with the surface of the upstream-side first inverting member 51 to be obliquely wound therearound. The continuous paper 9 is thereby twisted 90 degrees and is inverted. In this state, the continuous paper 9 is sent out toward the heating roller 53. After that, the continuous paper 9 is transported along with the rotation of the heating roller 53 in the direction of arrow in FIG. 3 while the back surface 9*b* is in contact with the heating roller 53 to be obliquely wound therearound from the upper side, and is sent out to return toward the downstream-side first inverting member 52. Finally, the heated continuous paper 9 is passed while the back surface 9*b* is in contact with the surface of the downstream-side first inverting member 52 to be obliquely wound therearound. The continuous paper 9 is thereby twisted 90 degrees and is inverted. In this state, the continuous paper 9 is sent out from the preheating device 5 with the front surface 9*a* facing up, and is transported toward the fixing device 40 provided on the downstream side. In the preheating device 5, the continuous paper 9 is heated from the back surface 9*b* at a required temperature (for example, a temperature set within the range of 90° C. to 180° C.) by the heating roller 53.

Subsequently, as illustrated in FIGS. 2 and 5, the continuous paper 9 preheated in the preheating device 5 is sent into (the fixing nip FN of) the fixing device 40 in the state where the front surface 9*a* having the toner image formed thereon faces up, is subjected to the fixing operation of the toner image, and is then sent out from the fixing device 40.

At this time, the continuous paper 9 is introduced into and transported through the fixing nip FN in a state where the front surface 9*a* is in contact with the heating belt 43 of the heating rotating body 41. Thus, the unfixed toner image on the continuous paper 9 is fixed by the fixing operation using heat and pressure at the fixing nip FN. In this fixing operation of the toner image at the fixing nip FN, since the continuous paper 9 is preheated from the back surface 9*b* in the preheating device 5, the continuous paper 9 is subjected to a formal fixing operation at the fixing nip FN in a state where the toner image is starting to be melted by heating. Hence, fixing may be more quickly and reliably performed than when preheating is not performed.

After the unfixed toner image is fixed in the fixing system 4, the continuous paper 9 is transported toward the storage device 16 by the transport roller pair 19. At this time, when the continuous paper 9 is transported by the transport roller pair 19, the elevating roller 18*c* of the adjusting mechanism 18 in the storage device 16 starts moving down from the upper specified position, and moves down to finally reach the lower specified position. In this stage, the take-up roller 17 rotates to take up the continuous paper 9. Thus, the continuous paper 9 is stored.

By repeating the above operation, a full-color image formed by combining four color toners is continuously formed on one surface (front surface 9*a*) of the continuous paper 9.

While the fixing system 4 includes the preheating device 5 in the image forming apparatus 1, the heating roller 53 of the preheating device 5 is disposed further on the outside than the side edge portion 9*d* of the continuous paper 9 (see, for example, FIG. 5).

Second Exemplary Embodiment

Figure 6:
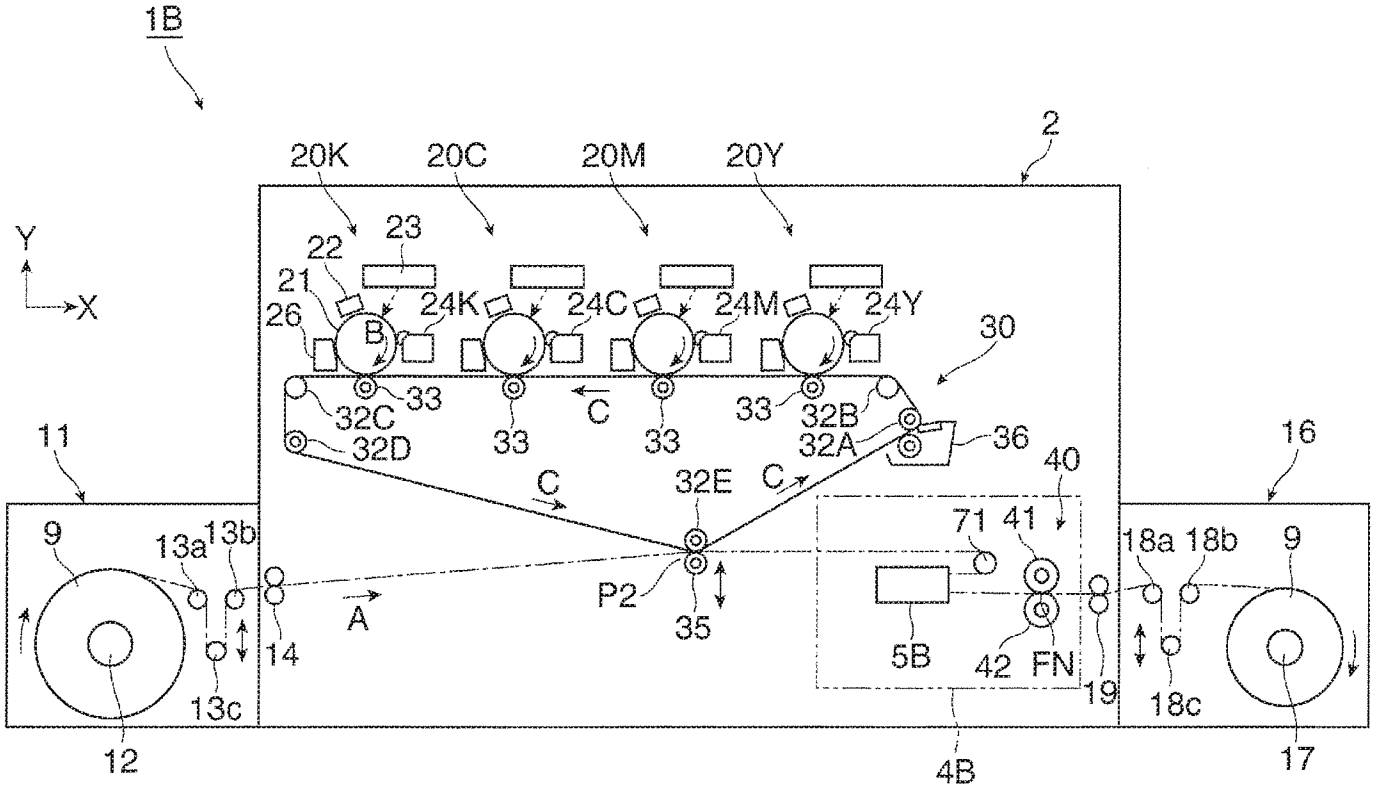
FIG. 6 is a schematic explanatory view illustrating a configuration of an image forming apparatus according to a second exemplary embodiment.
Figure 7:
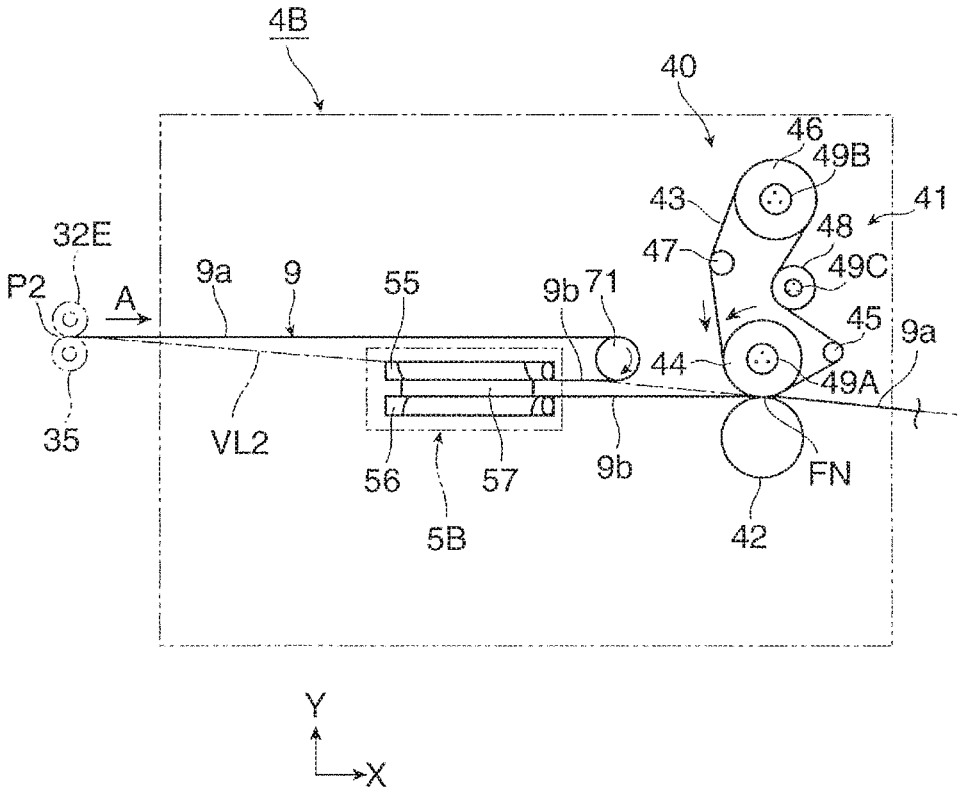
FIG. 7 is a schematic explanatory view illustrating a structure of a fixing system in the image forming apparatus illustrated in FIG. 6.
Figure 8:
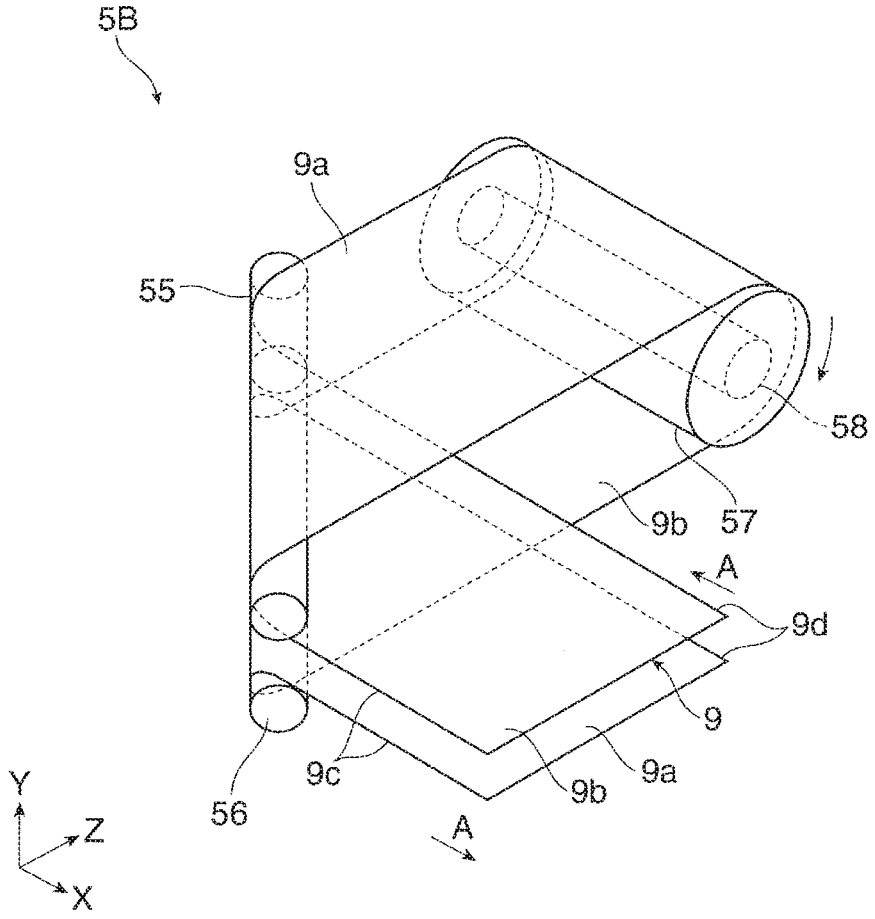
FIG. 8 is a schematic perspective view illustrating a structure of a preheating device in the fixing system illustrated in FIG. 7.

FIGS. 6 to 8 illustrate an image forming apparatus according to a second exemplary embodiment. FIG. 6 illustrates a general outline of the image forming apparatus, FIG. 7 illustrates a fixing system provided in the image forming apparatus, and FIG. 8 illustrates a preheating device provided in the image forming apparatus or the fixing system.

As schematically illustrated in FIG. 6, an image forming apparatus 1B according to the second exemplary embodiment includes a supply device 11, an image forming device 2, a fixing system 4B, and a storage device 16. Compared with the image forming apparatus 1 of the first exemplary embodiment, the fixing system 4B is partly different in structure from the fixing system 4 of the first exemplary embodiment, but the supply device 11, the image forming device 2, and the storage device 16 have the same structures.

As illustrated in, for example, FIGS. 6 and 7, the fixing system 4B of the second exemplary embodiment includes a fixing device 40, a preheating device 5B, and a guide roller 71. Among these, the fixing device 40 has the same structure as that of the fixing device 40 in the fixing system 4 of the first exemplary embodiment (FIG. 2).

[Structure of Preheating Device]

As illustrated in, for example, FIGS. 7 and 8, the preheating device 5B includes two first inverting members 55 and 56 and a heating roller 57 serving as an example of a heating rotating body. The first inverting members 55 and 56 are disposed at different positions while obliquely intersecting the feeding direction A of continuous paper 9 on which a toner image is formed, and inverts the continuous paper 9 by passing a back surface 9*b* of the continuous paper 9, which does not have the toner image, therealong before a fixing operation. The heating roller 57 is disposed at a position further on an outside than side edge portions 9*c* and 9*d* of the continuous paper 9 in the feeding direction A, and preheats a portion of the back surface 9*b* of the continuous paper 9 between the first inverting members 55 and 56 before the fixing operation by passing the portion of the back surface 9*b* so that the portion of the back surface 9*b* is wound around the heating roller 57.

In FIG. 7, a one-dot chain line VL2 is an imaginary straight line that connects a second transfer position P2 in the image forming device 2 and a fixing nip FN in the fixing device 40 in the shortest distance.

The two first inverting members 55 and 56 have structures substantially similar to those of the first inverting member 51 and 52 in the preheating device 5 of the first exemplary embodiment. However, the first inverting members 55 and 56 are arranged in a slight different manner as follows because the guide roller 71 to be described later is disposed on the upstream side of the preheating device 5B.

That is, while the first inverting members 55 and 56 in the second exemplary embodiment are fixedly arranged to intersect the feeding direction A of the continuous paper 9 at an angle of 45 degrees, the arrangement thereof is slightly different in the following points.

First, the upstream-side first inverting member 55 on the upstream side in the feeding direction A of the continuous paper 9 is disposed at a position on a relatively upper side of the downstream-side first inverting member 56 provided on the downstream side, and intersects the feeding direction A. The upstream-side first inverting member 55 is used to introduce continuous paper 9 sent into the preheating device 5B from the lower side of the first inverting member 55 and to pass the continuous paper 9 on the upper side thereof.

In contrast, the downstream-side first inverting member 56 is disposed at a position on a relatively lower side of the upstream-side first inverting member 55 while being substantially parallel to the upstream-side first inverting member 55. This is a different point. The downstream-side first inverting member 56 is used to introduce the continuous paper 9 sent from the heating roller 57 from the lower side of the first inverting member 56 and to pass the continuous paper 9 on the upper side thereof. Thus, as illustrated in, for example, FIG. 8, the continuous paper 9 inverted and sent out by the downstream-side first inverting member 56 is sent out in a feeding direction directly opposite from the feeding direction A of the continuous paper 9 when the continuous paper 9 is sent to the upstream-side first inverting member 55.

Figure 9:
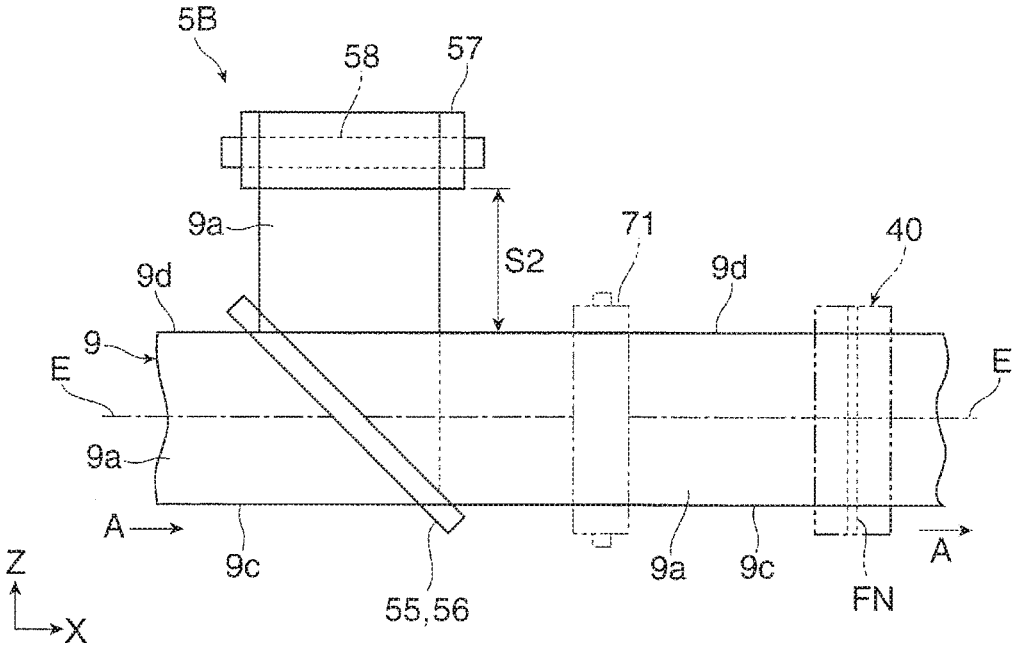
FIG. 9 is a schematic explanatory view illustrating a state of the fixing system of FIG. 7 when viewed from above.

As illustrated in FIGS. 8 and 9, the heating roller 57 is disposed at a position spaced outward by a predetermined distance S2 from one of the side edge portions 9*c* and 9*d* of the continuous paper 9 in the feeding direction A (the side edge portion 9*d* in the second exemplary embodiment) in a state in which the axial direction of the heating roller 57 is substantially parallel to the feeding direction A. While the distance S2 at this time is equal to the distance S1 of the heating roller 53 in the preheating device 5 of the first exemplary embodiment, it may be set at a different value.

Similarly to the heating roller 53 in the preheating device 5 of the first exemplary embodiment, the heating roller 57 is constituted of a cylindrical roller base made of, for example, metal, and a heat source 58, such as a halogen lamp, disposed in an internal space of the roller base. Also, similarly to the heating roller 53, the roller base of the heating roller 57 is rotatable, and is driven to rotate along with the motion (transport movement) of the continuous paper 9 passing to be wound around the heating roller 57. In the second exemplary embodiment, the winding angle of the back surface 9*b* of the continuous paper 9 around the heating roller 57 is also set to be 180 degrees or more from the viewpoint of reliably heating the back surface 9*b* of the continuous paper 9.

As illustrated in FIGS. 6 and 7, the fixing system 4B includes a guide roller 71 serving as an example of a guide rotating body on the upstream side of the preheating device 5B. The guide roller 71 guides the continuous paper 9 in a different direction by passing the back surface 9*b* of the continuous paper 9 so that the back surface 9*b* is wound around the guide roller 71.

The guide roller 71 is disposed at a front position upstream of the upstream-side first inverting member 55, of the two first inverting members 55 and 56 of the preheating device 5B, in the feeding direction A of the continuous paper 9 in a state in which the axial direction of the guide roller 71 orthogonally intersects the feeding direction A of the continuous paper 9. For example, the guide roller 71 is a cylindrical member made of metal. Also, the guide roller 71 is rotatably disposed between the second transfer position P2 in the image forming device 2 and the fixing device 40 and at a position closer to the fixing device 40. The guide roller 71 in the second exemplary embodiment is used to guide and return the continuous paper 9 sent out from the second transfer position P2 of the image forming device 2 toward the second transfer position P2 by turning back and passing the continuous paper 9 while the back surface 9*b* is wound in contact with the guide roller 71.

[Operation of Fixing System]

In this fixing system 4B, as illustrated in FIGS. 6 and 7, the continuous paper 9 sent out from the second transfer position P2 in the image forming device 2 is transported to pass through the guide roller 71, the preheating device 5B, and the fixing device 40 in this order.

First, as illustrated in, for example, FIG. 7, the continuous paper 9 is transported to the guide roller 71 in a state where the front surface 9*a* on which a toner image is formed faces up, and is passed along the guide roller 71 so that the back surface 9*b* is wound around the guide roller 71. Thus, the continuous paper 9 is guided in a different direction that is directly opposite from the feeding direction A of the continuous paper 9 when the continuous paper 9 is sent out from the second transfer position P2 and that returns the continuous paper 9 toward the second transfer position P2 again (however, this direction is a part of the feeding direction A).

Next, as illustrated in FIGS. 7 and 8, the continuous paper 9 transported by the guide roller 71 to return toward the second transfer position P2 is sent into the preheating device 5B in a state where the back surface 9*b* on which the toner image is not formed faces up. In the preheating device 5B, the continuous paper 9 is preheated from the back surface 9*b* before the fixing operation, and is inverted. The continuous paper 9 is then sent out from the preheating device 5B with the front surface 9*a* facing up.

At this time, in the preheating device 5B, the continuous paper 9 is passed while the back surface 9*b* is in contact with the surface of the upstream-side first inverting member 55 to be obliquely wound therearound, is twisted 90 degrees, and is inverted. In this state, the continuous paper 9 is sent out toward the heating roller 57. After that, the continuous paper 9 is transported along with the rotation of the heating roller 57 in the direction of arrow in FIGS. 7 and 8 while the back surface 9*b* is in contact with the heating roller 57 to be wound therearound from the upper side, and is then sent out to return toward the downstream-side first inverting member 56. Finally, the heated continuous paper 9 is passed while the back surface 9*b* is in contact with the surface of the downstream-side first inverting member 56 to be wound therearound, is twisted 90 degrees, and is inverted. The continuous paper 9 is then sent out from the preheating device 5B with the front surface 9*a* facing up, and is transported toward the fixing device 40 provided on the downstream side. In the preheating device 5B, the continuous paper 9 is heated from the back surface 9*b* at a required temperature (for example, a temperature set within the range of 90° C. to 180° C.) by the heating roller 57.

Finally, as illustrated in FIGS. 7 and 9, the continuous paper 9 preheated by the preheating device 5B is sent into (the fixing nip FN of) the fixing device 40 in the state where the front surface 9*a* having the toner image thereon faces up, is subjected to the fixing operation of the toner image, and is then sent out from the fixing device 40.

While the fixing system 4B includes the preheating device 5B in the image forming apparatus 1B, the heating roller 57 in the preheating device 5B is disposed further on the outside than the side edge portion 9*d* of the continuous paper 9 (see, for example, FIG. 9).

Third Exemplary Embodiment

Figure 10:
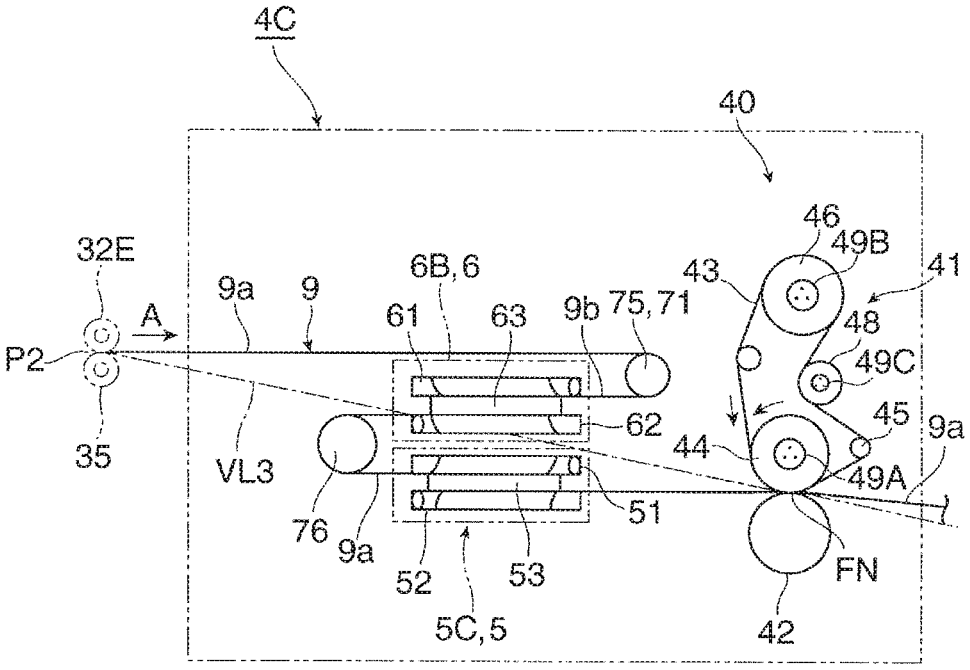
FIG. 10 is a schematic explanatory view illustrating a structure of a fixing system according to a third exemplary embodiment.

FIG. 10 illustrates a fixing system according to a third exemplary embodiment.

As illustrated in FIG. 10, a fixing system 4C according to the third exemplary embodiment includes a fixing device 40, a preheating device 5C, an inverting device 6B, a first guide roller 75, and a second guide roller 76.

Among these, the fixing device 40 has the same structure as that of the fixing device 40 (FIG. 2) in the fixing system 4 of the first exemplary embodiment. The preheating device 5C and the inverting device 6B have the same structures as those of the preheating device 5 (for example, FIG. 3) and the inverting device 6 (for example, FIG. 4) in the first exemplary embodiment. Further, the first guide roller 75 has the same structure as that of the guide roller 71 (for example, FIG. 7) in the second exemplary embodiment.

In FIG. 10, a one-dot chain line VL3 is an imaginary straight line that connects a second transfer position P2 in an image forming device 2 and a fixing nip FN in the fixing device 40 in the shortest distance.

The second guide roller 76 is disposed in a state in which the axial direction thereof orthogonally intersects the feeding direction A of continuous paper 9. With reference to the first guide roller 75, after the continuous paper 9 is guided by the first guide roller 75, is returned toward the second transfer position P2 again, and is inverted by passing through the inverting device 6B, the second guide roller 76 passes the continuous paper 9 therealong so that the back surface 9*b* of the continuous paper 9 is wound around the second guide roller 76, and finally guides the continuous paper 9 in a direction toward (the fixing nip FN) in the fixing device 40. The second guide roller 76 is disposed in a state in which the direction of a rotation axis thereof is substantially parallel to the direction of a rotation axis of the first guide roller 75.

Also, with reference to the preheating device 5C, the second guide roller 76 is disposed further on the front side serving as the upstream side than the upstream-side first inverting member 51, of the first inverting members 51 and 52 in the preheating device 5C, in the feeding direction A of the continuous paper 9.

Further, for example, the second guide roller 76 is a cylindrical member made of metal. The second guide roller 76 is rotatably disposed at a position closer to the second transfer position P2 in the image forming device 2 between the second transfer position P2 and the fixing device 40.

[Operation of Fixing System]

Figure 11:
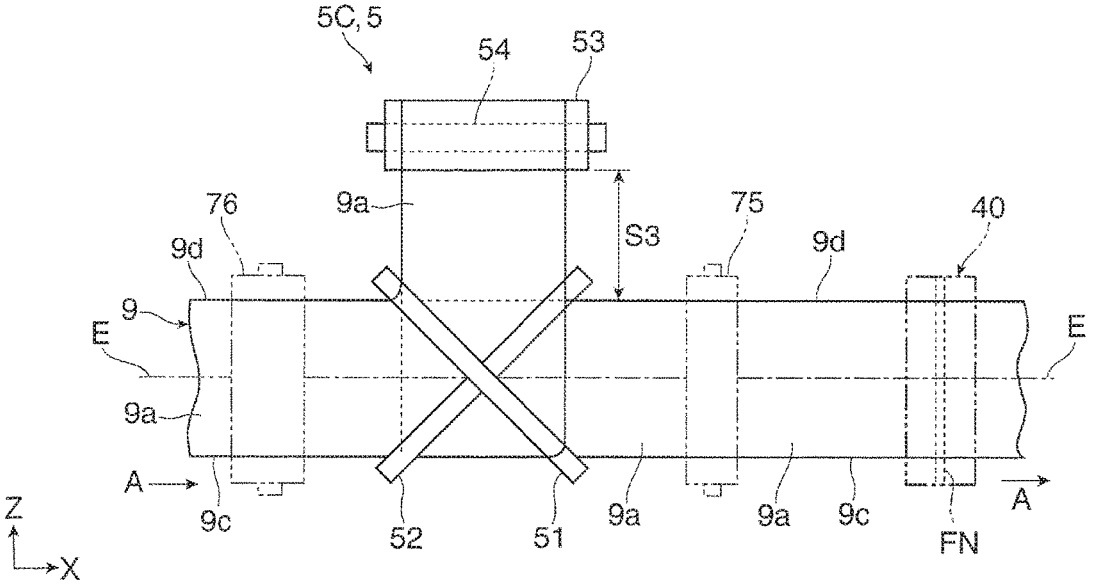
FIG. 11 is a schematic explanatory view illustrating a state of the fixing system of FIG. 10 when viewed from above.

In this fixing system 4C, as illustrated in FIGS. 10 and 11, the continuous paper 9 sent out from the second transfer position P2 in the image forming device 2 is transported to pass through the first guide roller 75, the inverting device 6B, the second guide roller 76, the preheating device 5C, and the fixing device 40 in this order. In FIG. 11, the inverting device 6B is not illustrated.

As illustrated in, for example, FIG. 10, the continuous paper 9 is first transported to the first guide roller 75 in a state where the front surface 9*a* on which the toner image is formed faces up, and is passed while the back surface 9*b* is wound around the first guide roller 75. Thus, the continuous paper 9 is guided in a different direction that is directly opposite from the feeding direction A of the continuous paper 9 when the continuous paper 9 is sent out from the second transfer position P2 and that returns the continuous paper 9 toward the second transfer position P2 again.

Next, as illustrated in FIG. 10, the continuous paper 9 transported by the first guide roller 75 to return toward the second transfer position P2 is sent into the inverting device 6B in a state where the back surface 9*b* on which the toner image is not formed faces up, is inverted, and is then sent out from the inverting device 6B with the front surface 9*a* facing up.

At this time, in the inverting device 6B, the continuous paper 9 is passed while the back surface 9*b* is in contact with the surface of an upstream-side second inverting member 61 to be obliquely wound around the surface of the second inverting member 61. The continuous paper 9 is thereby twisted 90 degrees, is inverted, and is sent out toward a relay roller 63, almost similarly to the inverting device 6 of the first exemplary embodiment. After that, the continuous paper 9 is transported along with the rotation of the relay roller 63 while the back surface 9*b* is in contact with the relay roller 63 to be wound around the relay roller 63 from the lower side, and is then sent out to return toward a downstream-side second inverting member 62. Finally, the continuous paper 9 is passed while the back surface 9*b* is in contact with the surface of the downstream-side second inverting member 62 to be obliquely wound around the surface of the second inverting member 62. The continuous paper 9 is thereby twisted 90 degrees and is inverted. Then, the continuous paper 9 is sent out from the inverting device 6B with the back surface 9*b* facing up, and is transported toward the second guide roller 76 provided on the downstream side.

Next, as illustrated in FIGS. 10 and 11, the continuous paper 9 inverted by the inverting device 6B is transported to the second guide roller 76 downstream of the inverting device 6B, and is passed while the back surface 9*b* is wound around the second guide roller 76. Thus, the continuous paper 9 is guided in a different direction (the original feeding direction A) which is directly opposite from the feeding direction of the continuous paper 9 when the continuous paper 9 is sent from the first guide roller 75 through the inverting device 6B and which is directed toward the fixing nip FN in the fixing device 40.

Next, the continuous paper 9 guided by the second guide roller 76 is sent into the preheating device 5C in a state where the back surface 9*b* on which the toner image is not formed faces up, is preheated from the back surface 9*b* before the fixing operation, and is inverted. Then, the continuous paper 9 is sent out from the preheating device 5C with the front surface 9*a* facing up.

At this time, in the preheating device 5C, as illustrated in, for example, FIGS. 3, 10, and 11, the continuous paper 9 is passed while the back surface 9*b* is in contact with the surface of the upstream-side first inverting member 51 to be obliquely wound around the surface of the first inverting member 51 from the lower side. The continuous paper 9 is thereby twisted 90 degrees, and is inverted. In this state, the continuous paper 9 is sent out toward the heating roller 53. After that, the continuous paper 9 is transported along with the rotation of the heating roller 53 in the direction of arrow in FIG. 3 while the back surface 9*b* is in contact with the heating roller 53 to be wound around the heating roller 53 from the upper side, and is then sent out to return toward the downstream-side first inverting member 52. Finally, the heated continuous paper 9 is passed while the back surface 9*b* is in contact with the surface of the downstream-side first inverting member 52 to be obliquely wound around the surface of the downstream-side first inverting member 52 from the lower side. The continuous paper 9 is thereby twisted 90 degrees, and is inverted. The continuous paper 9 is sent out from the preheating device 5C with the front surface 9*a* facing up, and is transported toward the fixing device 40 provided on the downstream side. In the preheating device 5C, the continuous paper 9 is heated from the back surface 9*b* at a required temperature by the heating roller 53.

Finally, as illustrated in FIGS. 10 and 11, the continuous paper 9 preheated in the preheating device 5C is sent into (the fixing nip FN in) the fixing device 40 while the front surface 9*a* on which the toner image is formed faces up, is subjected to the fixing operation of the toner image, and is then sent out from the fixing device 40.

In this fixing system 4C, the heating roller 53 in the preheating device 5C is also disposed at the position spaced outward by a predetermined distance S3 from a side edge portion 9*d* of the continuous paper 9 (see, for example, FIG. 11). While the distance S3 is set at the same value as the distance S1 in the first exemplary embodiment, it may be set at a different value.

Fourth Exemplary Embodiment

Figure 12:
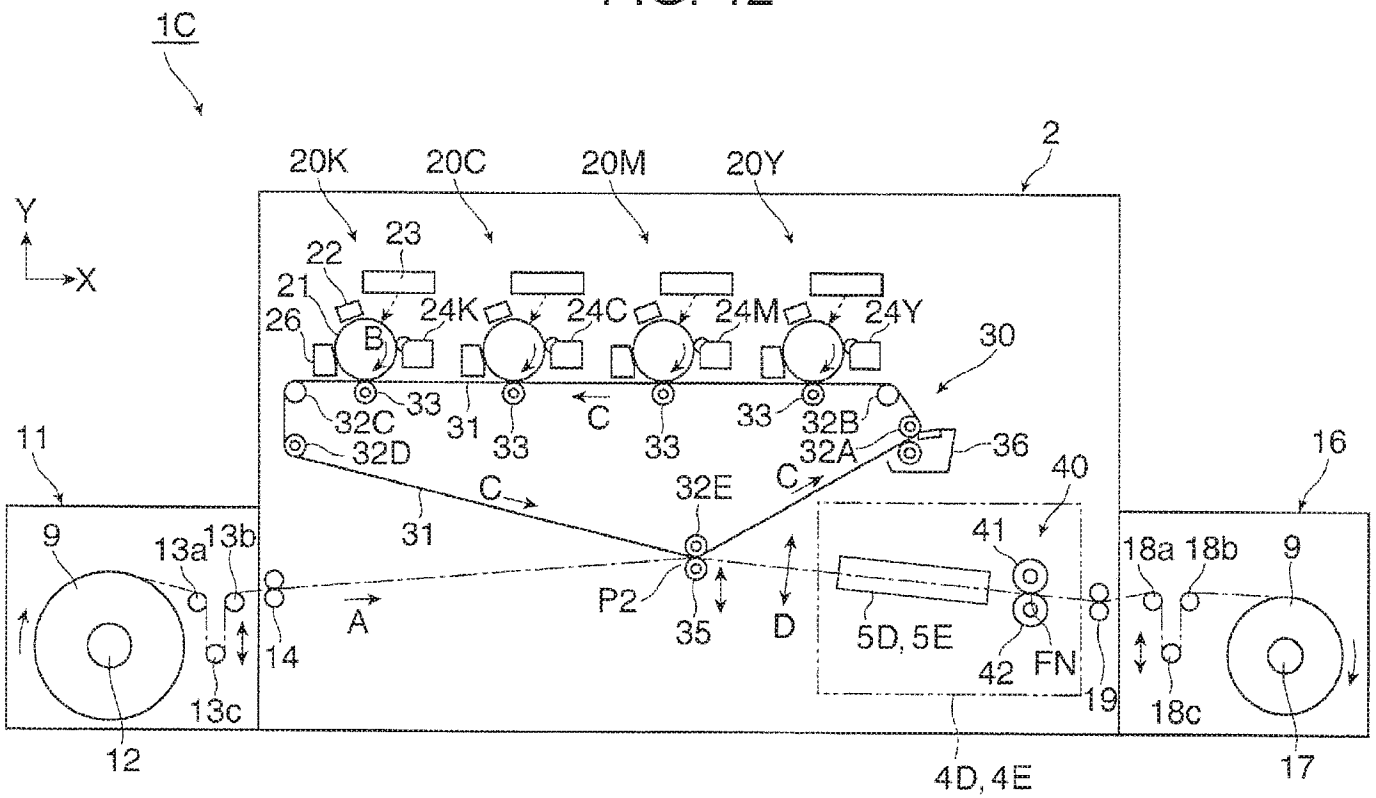
FIG. 12 is a schematic explanatory view illustrating a configuration of an image forming apparatus according to a fourth exemplary embodiment.
Figure 13:
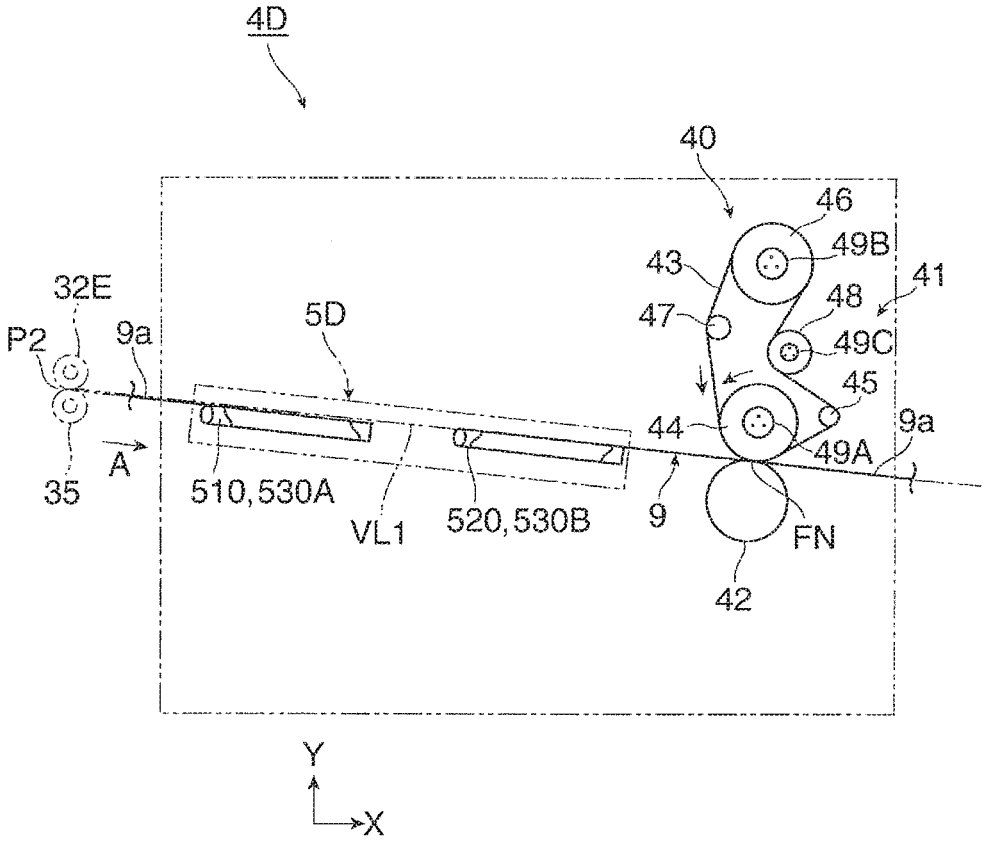
FIG. 13 is a schematic explanatory view illustrating a structure of a fixing system in the fourth exemplary embodiment.
Figure 14:
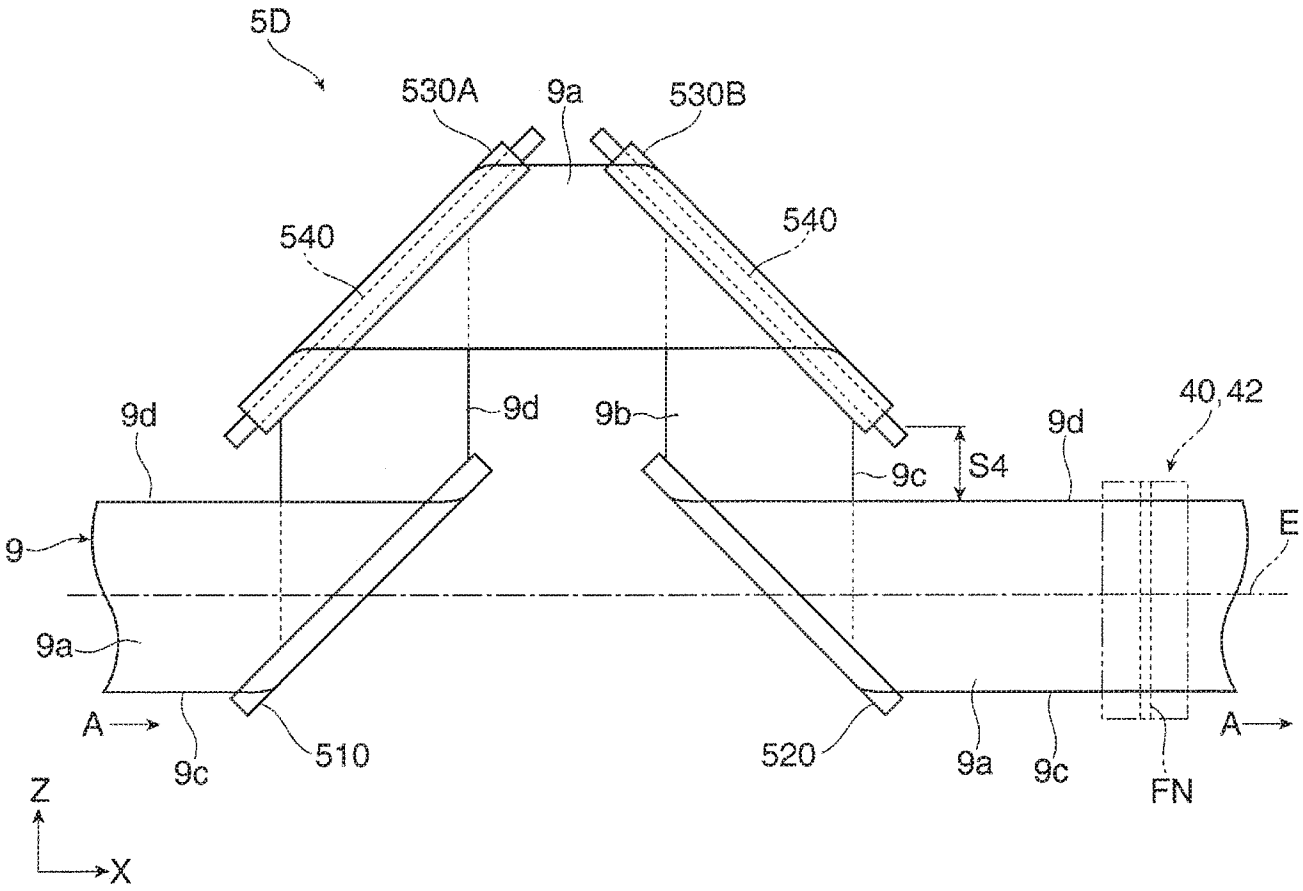
FIG. 14 is a schematic explanatory view illustrating a state of the fixing system of FIG. 13 when viewed from above.

FIGS. 12 to 14 illustrate an image forming apparatus according to a fourth exemplary embodiment. FIG. 12 illustrates a general outline of the image forming apparatus, FIG. 13 illustrates a fixing system provided in the image forming apparatus, and FIG. 14 illustrates a preheating device provided in the image forming apparatus or the fixing system.

As schematically illustrated in FIG. 12, an image forming apparatus 1C according to the fourth exemplary embodiment includes a supply device 11, an image forming device 2, a fixing system 4D, and a storage device 16. The structure of the fixing system 4D is partly different from that of the fixing system 4 in the image forming apparatus 1 of the first exemplary embodiment, but the other devices, that is, the supply device 11, the image forming device 2, and the storage device 16 have the same structures.

As illustrated in FIGS. 12 and 13, the fixing system 4D in the fourth exemplary embodiment includes a fixing device 40 and a preheating device 5D. The fixing device 40 has the same structure as that of the fixing device 40 (FIG. 2) in the fixing system 4 of the first exemplary embodiment.

[Structure of Preheating Device]

As illustrated in FIGS. 13 and 14, the preheating device 5D includes two first inverting members 510 and 520 and two heating rollers 530A and 530B serving as an example of a heating rotating body. The first inverting members 510 and 520 are disposed at different positions while obliquely intersecting a feeding direction A of continuous paper 9 on which a toner image is formed, and invert the continuous paper 9 by passing a back surface 9*b* of the continuous paper 9, on which the toner image is not formed, therealong before a fixing operation. The heating rollers 530A and 530B are disposed at positions further on an outside than a side edge portion 9*d* of the continuous paper 9 in the feeding direction A, and preheat the continuous paper 9 before the fixing operation by passing the continuous paper 9 while a portion of the back surface 9*b* of the continuous paper 9 between the first inverting members 510 and 520 is wound around the heating rollers 530A and 530B.

In FIG. 13, a one-dot chain line VL1 is an imaginary straight line that connects a second transfer position P2 in the image forming device 2 and a fixing nip FN in the fixing device 40 in the shortest distance.

The two first inverting members 510 and 520 have structures substantially similar to those of the first inverting members 51 and 52 in the preheating device 5 of the first exemplary embodiment. The first inverting members 510 and 520 are fixedly disposed to obliquely intersect the feeding direction A of the continuous paper 9 at an angle of 45 degrees.

Also, the two first inverting members 510 and 520 are arranged as follows in a manner slightly different from the first inverting members 51 and 52 in the preheating device 5 of the first exemplary embodiment because the two heating rollers 530A and 530B are arranged.

That is, since the two heating rollers 530A and 530B are arranged in a substantially horizontal state, the two first inverting members 510 and 520 are arranged so that upper ends (top portions) thereof are at the same height as the imaginary straight line VL1 connecting the second transfer position P2 in the image forming device 2 and the fixing nip FN in the fixing device 40 in the shortest distance, as illustrated in FIG. 13. There is no height difference between the first inverting members 510 and 520 and the imaginary straight line VL1. In this respect, the first inverting members 51 and 52 in the preheating device 5 of the first exemplary embodiment are arranged so that the upper ends thereof have a height difference from the imaginary straight line VL1 (FIG. 2).

Similarly to the heating roller 53 in the preheating device 5 of the first exemplary embodiment, the two heating rollers 530A and 530B are each constituted of a cylindrical roller base made of, for example, metal, and a heat source 540, such as a halogen lamp, disposed in an internal space of the roller base. Also, similarly to the heating roller 53, the roller bases of the heating rollers 530A and 530B are rotatably disposed, and are driven to rotate along with the motion (transport movement) of continuous paper 9 that passes while winding around the heating rollers 530A and 530B.

As illustrated in FIG. 14, the two heating rollers 530A and 530B are arranged at positions spaced outward by a predetermined distance S4 from one of side edge portions 9*c* and 9*d* of the continuous paper 9 in the feeding direction A (side edge portion 9*d* in the fourth exemplary embodiment) in a state in which the axial directions of the heating rollers 530A and 530B obliquely intersect the feeding direction A of the continuous paper 9.

Specifically, the first heating roller 530A on the upstream side in the feeding direction of the continuous paper 9 is disposed so that the axial direction thereof obliquely intersects the feeding direction of the continuous paper 9 when the continuous paper 9 is sent out from the upstream-side first inverting member 510 at an angle of about 45 degrees. In other words, the first heating roller 530A is disposed in such a relation that the axial direction thereof is parallel to the axial direction of the first inverting member 510. The first heating roller 530A is used to introduce the continuous paper 9 sent from the first inverting member 510 from the lower side, to wind the continuous paper 9 around the first heating roller 530A, and to send out the continuous paper 9 from the upper side. At this time, the winding angle of the back surface 9*b* of the continuous paper 9 around the first heating roller 530A is about 180 degrees.

The second heating roller 530B downstream of the first heating roller 530A in the transport direction of the continuous paper 9 is disposed so that the axial direction thereof obliquely intersects the feeding direction of the continuous paper 9 sent out from the first heating roller 530A at an angle of about 45 degrees. In other words, the second heating roller 530B is disposed in such a relation that the axial direction thereof is parallel to the axial direction of the downstream-side first inverting member 520. The second heating roller 530B is used to introduce the continuous paper 9 sent from the first heating roller 530A from the upper side, to wind the continuous paper 9 around the peripheral surface of the second heating roller 530B, and to send out the continuous paper 9 from the lower side. At this time, the winding angle of the back surface 9*b* of the continuous paper 9 around the second heating roller 530B is also about 180 degrees.

[Operation of Fixing System]

In this fixing system 4D, as illustrated in FIGS. 13 and 14, continuous paper 9 sent out from the second transfer position P2 in the image forming device 2 is transported to pass through the preheating device 5D and the fixing device 40 in this order.

First, as illustrated in, for example, FIG. 13, the continuous paper 9 is sent into the preheating device 5D in a state where the front surface 9*a* on which a toner image is formed faces up, is preheated from the back surface 9*b* before the fixing operation, and is inverted. Then, the continuous paper 9 is sent out from the preheating device 5D with the front surface 9*a* facing up.

At this time, in the preheating device 5D, the continuous paper 9 is passed while the front surface 9*a* is in contact with the surface of the upstream-side first inverting member 510 to be obliquely wound around the surface from the upper side. The continuous paper 9 is thereby twisted 90 degrees, and is inverted. In this state, the continuous paper 9 is sent out from the lower side of the first inverting member 510 toward the first heating roller 530A.

The continuous paper 9 sent out from the first inverting member 510 is transported along the driven rotation of the first heating roller 530A and heated while the back surface 9*b* is in contact with the first heating roller 530A to be wound around the first heating roller 530A from the lower side. The continuous paper 9 is thereby twisted 90 degrees and is inverted. In this state, the continuous paper 9 is sent out from the upper side of the first heating roller 530A toward the second heating roller 530B. Also, the continuous paper 9 sent out from the first heating roller 530A is transported along with the driven rotation of the second heating roller 530B and heated while the back surface 9*b* is in contact with the second heating roller 530B to be wound around the second heating roller 530B from the upper side. The continuous paper 9 is thereby twisted 90 degrees and is inverted. In this state, the continuous paper 9 is sent out from the lower side of the second heating roller 530B toward the downstream-side first inverting member 520.

Finally, after heated by the two heating rollers 530A and 530B, the continuous paper 9 is passed while the back surface 9*b* is in contact with the surface of the downstream-side first inverting member 520 to be obliquely around the surface from the lower side. The continuous paper 9 is thereby twisted 90 degrees and is inverted. Then, the continuous paper 9 is sent out from the preheating device 5D with the front surface 9*a* facing up, and is transported toward the fixing device 40 provided on the downstream side.

In the preheating device 5D, the continuous paper 9 is heated from the back surface 9*b* at a required temperature (for example, a temperature set within the range of 90° C. to 180° C.) by the two heating rollers 530A and 530B.

Next, as illustrated in FIG. 13, the continuous paper 9 preheated by the preheating device 5D is sent into (the fixing nip FN in) the fixing device 40 in a state where the front surface 9*a* on which the toner image is formed faces up, is subjected to the fixing operation of the toner image, and is then sent out from the fixing device 40.

While the fixing system 4D in the image forming apparatus 1C includes the preheating device 5D, the two heating rollers 530A and 530B in the preheating device 5D are both disposed further on the outside than the side edge portion 9*d* of the continuous paper 9 (see, for example, FIG. 14).

In the image forming apparatus 1C, the two heating rollers 530A and 530B are arranged between the first inverting members 510 and 520 in the preheating device 5D of the fixing system 4D. Hence, preheating is performed by the preheating device 5D while the back surface 9*b* of the continuous paper 9 is wound into contact with the peripheral surfaces of the two heating rollers 530A and 530B in order at an angle of about 180 degrees.

Further, in the image forming apparatus 1C, as illustrated in FIGS. 12 and 13, the two first inverting members 510 and 520 and the two heating rollers 530A and 530B in the preheating device 5D of the fixing system 4D are all disposed almost along the imaginary straight line VL1, and are arranged with little height difference from the imaginary straight line VL1.

Fifth Exemplary Embodiment

Figure 15:
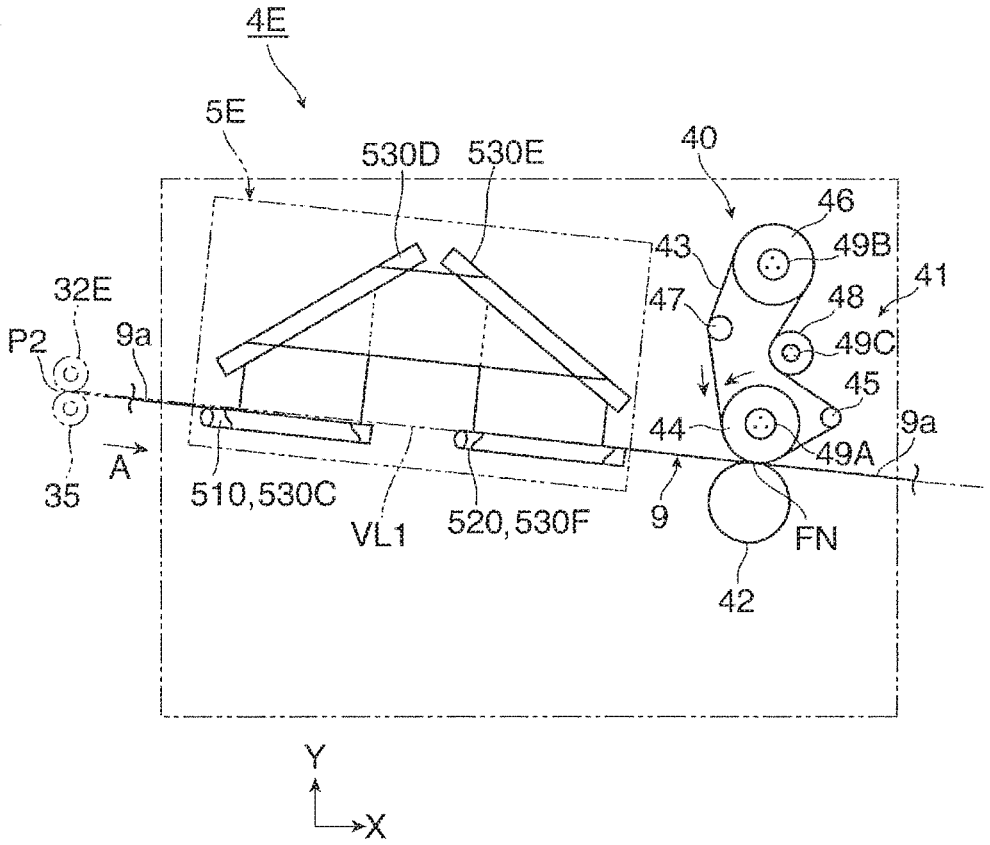
FIG. 15 is a schematic explanatory view illustrating a structure of a fixing system according to a fifth exemplary embodiment.
Figure 16:
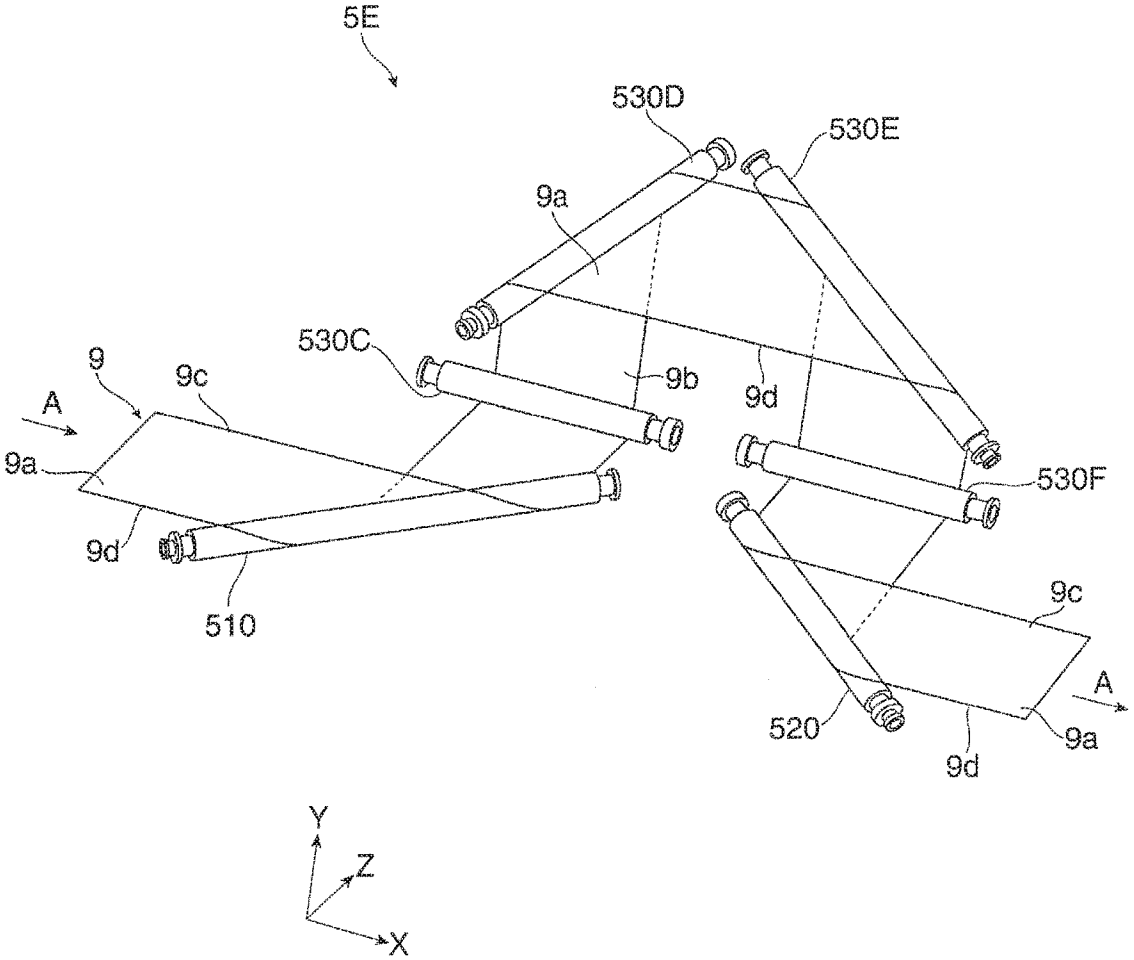
FIG. 16 is a schematic explanatory view illustrating a state of the fixing system of FIG. 15 when viewed from obliquely above.
Figure 17:
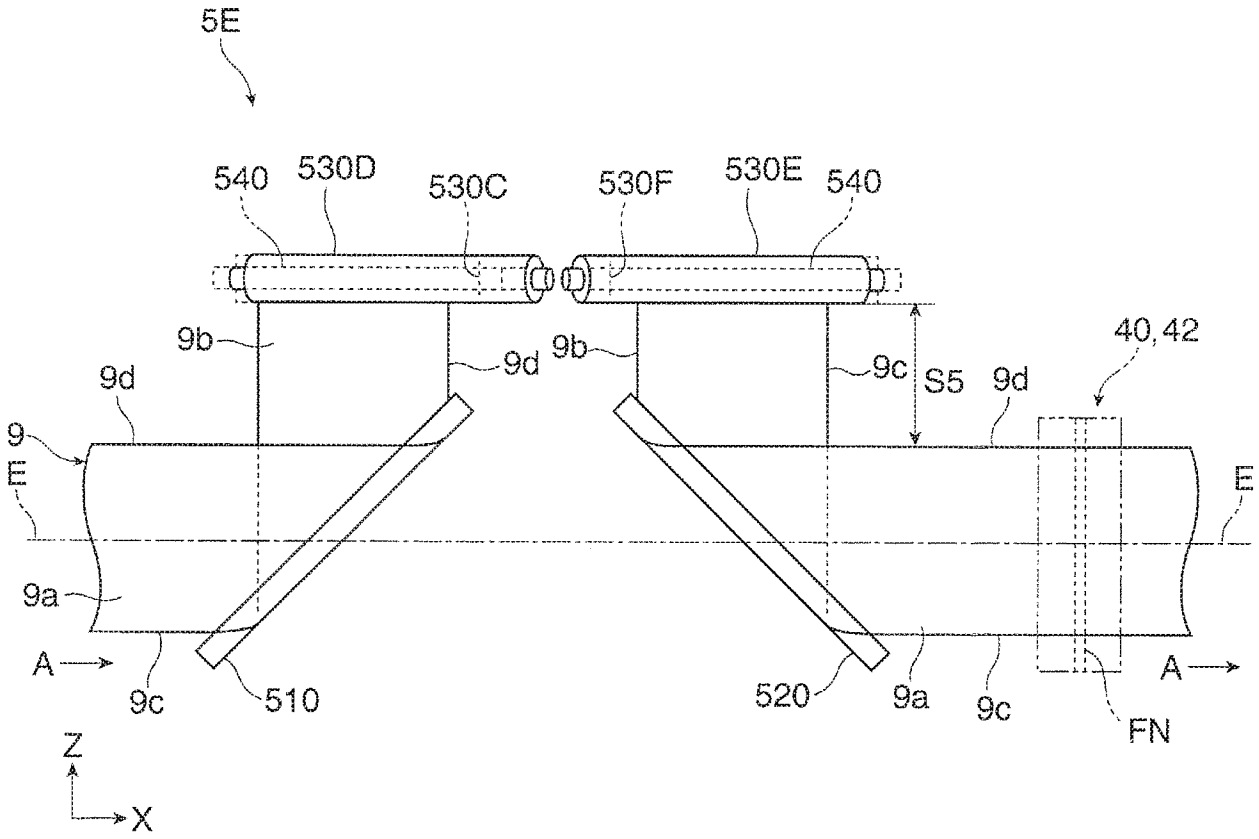
FIG. 17 is a schematic explanatory view illustrating a state of the fixing system of FIG. 15 when viewed from above.

FIGS. 15 to 17 illustrate a fixing system and so on according to a fifth exemplary embodiment. FIG. 15 illustrates a general outline of the fixing system, FIG. 16 illustrates a state of a preheating device provided in the fixing system, when viewed from obliquely above, and FIG. 17 illustrates the preheating device and so on.

As illustrated in FIG. 15, a fixing system 4E according to the fifth exemplary embodiment includes a fixing device 40 and a preheating device 5E. The fixing device 40 has the same structure as that of the fixing device 40 (FIG. 2) in the fixing system 4 of the first exemplary embodiment.

[Structure of Preheating Device]

As illustrated in, for example, FIGS. 15 and 16, the preheating device 5E includes two first inverting members 510 and 520 and four heating rollers 530C, 530D, 530E, and 530F serving as an example of a heating rotating body. The two first inverting members 510 and 520 are disposed at different positions while obliquely intersecting a feeding direction A of continuous paper 9 on which a toner image is formed, and invert the continuous paper 9 by passing a back surface 9*b* of the continuous paper 9, on which the toner image is not formed, therealong before a fixing operation. The four heating rollers 530C, 530D, 530E, and 530F are disposed at positions further on an outside than a side edge portion 9*d* of the continuous paper 9 in the feeding direction A, and preheat the continuous paper 9 before the fixing operation by passing and winding a portion of the back surface 9*b* of the continuous paper 9 between the first inverting members 510 and 520 around the heating rollers 530C to 530F.

In FIG. 15, a one-dot chain line VL1 is an imaginary straight line that connects a second transfer position P2 in an image forming device 2 and a fixing nip FN in the fixing device 40 in the shortest distance.

The two first inverting members 510 and 520 have structures substantially similar to those of the first inverting members 510 and 520 in the preheating device 5D of the fourth exemplary embodiment, and are fixedly arranged to obliquely intersect the feeding direction A of the continuous paper 9 at an angle of 45 degrees.

Each of the four heating rollers 530C, 530D, 530E, and 530F is constituted of a cylindrical roller base made of, for example, metal and a heat source 540, such as a halogen lamp, disposed in an internal space of the roller base, similarly to the two heating rollers 530A and 530B in the preheating device 5D of the fourth exemplary embodiment. In each of the heating rollers 530C, 530D, 530E, and 530F, the roller base is rotatably disposed and is driven to rotate along with the motion (transport movement) of the continuous paper 9 that passes while winding around the heating roller 530C, 530D, 530E, or 530F, similarly to the above-described two heating rollers 530A and 530B.

As illustrated in FIG. 17, the four heating rollers 530C, 530D, 530E, and 530F are disposed at positions spaced outward by a predetermined distance S5 from the side edge portion 9*d* of the continuous paper 9 in the feeding direction A in a state in which the axial directions thereof are parallel to the feeding direction A of the continuous paper 9 or obliquely intersect the feeding direction A.

Specifically, the first heating roller 530C on the most upstream side in the transport direction of the continuous paper 9 is disposed in a state where the axial direction thereof exists in the same plane passing the axis of the upstream-side first inverting member 510 and the axial direction is substantially parallel to the feeding direction A of the continuous paper 9. The first heating roller 530C is used to introduce the continuous paper 9 sent from the first inverting member 510 from the lower side, to wind the continuous paper 9 around the peripheral surface of the first heating roller 530C, and to vertically send out the continuous paper 9 from a rear side surface of the first heating roller 530C. At this time, the winding angle of the back surface 9*b* of the continuous paper 9 around the first heating roller 530C is about 90 degrees.

The second heating roller 530D downstream of the first heating roller 530C in the transport direction of the continuous paper 9 is disposed on the vertically upper side of the first heating roller 530C in a state where the axial direction thereof exists in the same plane passing the rotation axis of the first heating roller 530C, and is tilted at an angle of, for example, 45 degrees so that one end is located at a higher position than the other end. The second heating roller 530D is used to introduce the continuous paper 9, which is sent upward in the vertical direction from the first heating roller 530C, from a rear side surface, to wind the continuous paper 9 around the peripheral surface of the second heating roller 530D, and to send out the continuous paper 9 from a front side surface in a substantially horizontal direction (a direction along the imaginary straight line VL1). At this time, the winding angle of the back surface 9*b* of the continuous paper 9 around the second heating roller 530D is about 180 degrees.

The third heating roller 530E downstream of the second heating roller 530D in the transport direction of the continuous paper 9 is disposed in a state where the axial direction thereof exists in the same plane passing the rotation axis of the second heating roller 530D, and is tilted at an angle of, for example, 45 degrees so that one end thereof is located at a higher position than the other end. The second heating roller 530D and the third heating roller 530E are arranged in a chevron form, when viewed from the front side. The third heating roller 530E is used to introduce the continuous paper 9, which is sent in an upright position from the second heating roller 530D to move in a substantially horizontal direction, from a front side surface, to wind the continuous paper 9 around the peripheral surface of the third heating roller 530E, and to send out the continuous paper 9 downward in the substantially vertical direction from a rear side surface. At this time, the winding angle of the back surface 9*b* of the continuous paper 9 around the third heating roller 530E is about 180 degrees.

Further, the fourth heating roller 530F downstream of the third heating roller 530E in the transport direction of the continuous paper 9 is disposed in a state where the axial direction thereof exists in the same plane passing the axis of the downstream-side first inverting member 520 and the axial direction is substantially parallel to the feeding direction A of the continuous paper 9. The fourth heating roller 530F is used to introduce the continuous paper 9, which is sent from the third heating roller 530E, from a rear side surface, to wind the continuous paper 9 around the peripheral surface of the fourth heating roller 530F, and to send out the continuous paper 9 from the lower side in a substantially horizontal direction. At this time, the winding angle of the back surface 9*b* of the continuous paper 9 around the fourth heating roller 530F is about 90 degrees.

[Operation of Fixing System]

In this fixing system 4E, as illustrated in FIGS. 15 to 17, the continuous paper 9 sent out from the second transfer position P2 in the image forming device 2 is transported to pass through the preheating device 5E and the fixing device 40 in this order.

First, as illustrated in, for example, FIG. 16, the continuous paper 9 is sent into the preheating device 5E in a state where the front surface 9*a* on which the toner image is formed faces up, is preheated from the back surface 9*b* before the fixing operation, and is inverted. The continuous paper 9 is then sent out from the preheating device 5E with the front surface 9*a* facing up.

At this time, in the preheating device 5E, the continuous paper 9 is passed while the front surface 9*a* is in contact with the surface of the upstream-side first inverting member 510 to be obliquely wound around the surface from the upper side. The continuous paper 9 is thereby twisted 90 degrees and is inverted. In this state, the continuous paper 9 is sent out from the lower side of the first inverting member 510 toward the first heating roller 530C.

The continuous paper 9 sent out from the first inverting member 510 is transported along with the driven rotation of the first heating roller 530C and heated while the back surface 9*b* is in contact with the first heating roller 530C to be wound around the first heating roller 530C from the lower side. The feeding direction of the continuous paper 9 is thereby turned 90 degrees, and the continuous paper 9 is sent out upward in the vertical direction from the rear side surface toward the second heating roller 530D. Subsequently, the continuous paper 9 is transported along with the driven rotation of the second heating roller 530D and heated while the back surface 9*b* is in contact with the tilted second heating roller 530D to be wound around the second heating roller 530D from the rear side surface. The feeding direction of the continuous paper 9 is thereby twisted 90 degrees, and the the continuous paper 9 is inverted. In this state, the continuous paper 9 is sent out toward the third heating roller 530E upward in the substantially horizontal direction. Next, the continuous paper 9 is transported along the driven rotation of the tilted third heating roller 530E and heated while the back surface 9*b* is in contact with the third heating roller 530E to be wound around the third heating roller 530E from a front surface side. Thus, the feeding direction of the continuous paper 9 is twisted 90 degrees, and the continuous paper 9 is inverted. In this state, the continuous paper 9 is sent out downward in the vertical direction toward the fourth heating roller 530F.

Finally, the continuous paper 9 heated by the four heating rollers 530C, 530D, 530E, and 530F in order is passed while the back surface 9*b* is in contact with the surface of the downstream-side first inverting member 520 to be obliquely wound around the surface from the lower side. Thus, the continuous paper 9 is twisted 90 degrees and is inverted. The continuous paper 9 is sent out from the preheating device 5E with the front surface 9*a* facing up, and is then transported toward the fixing device 40 provided on the downstream side.

In this preheating device 5E, the continuous paper 9 is heated from the back surface 9*b* at a required temperature (for example, a temperature set within the range of 90° C. to 180° C.) by the four heating rollers 530C, 530D, 530E, and 530F.

Next, as illustrated in FIG. 17, the continuous paper 9 preheated by the preheating device 5E is sent into (the fixing nip FN in) the fixing device 40 in a state where the front surface 9*a* having the toner image thereon faces up, is subjected to the fixing operation of the toner image, and is then sent out from the fixing device 40.

While the fixing system 4E includes the preheating device 5E in the image forming apparatus 1C, the four heating rollers 530C, 530D, 530E, and 530F in the preheating device 5E are all disposed further on the outside than the side edge portion 9*d* of the continuous paper 9 (see, for example, FIG. 17).

In this fixing system 4E, since the four heating rollers 530C, 530D, 530E, and 530F are arranged between the first inverting members 510 and 520 in the preheating device 5E, preheating is performed by the preheating device 5E while the back surface 9*b* of the continuous paper 9 is wound into contact with the peripheral surfaces of the four heating rollers 530C to 530F in order at an angle of about 90 degrees, an angle of about 180 degrees, an angle of about 180 degrees, and an angle of about 90 degrees, respectively.

Other Exemplary Embodiments

Figure 18:
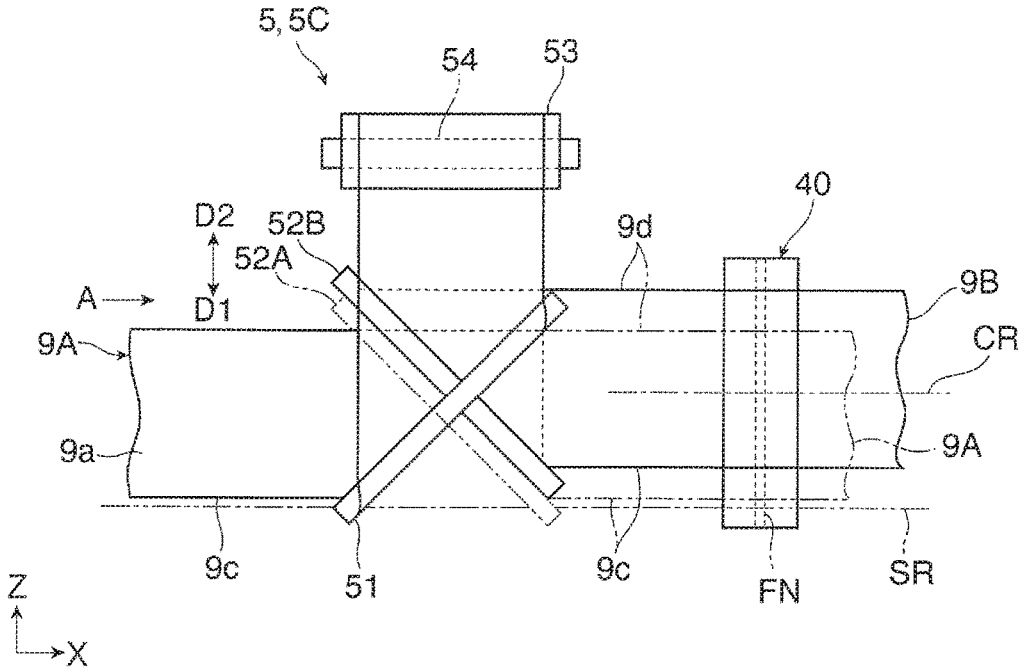
FIG. 18 is a schematic explanatory view illustrating another structure example of the preheating device in the fixing system illustrated in, for example, FIG. 2.

While the downstream-side first inverting member 52 is fixedly disposed to obliquely intersect the feeding direction A of the continuous paper 9 in the preheating device 5 of, for example, the first exemplary embodiment, the downstream-side first inverting member 52 of the two first inverting members 51 and 52 may be provided to be displaceable in a direction D (D2 in this exemplary embodiment) which allows the downstream-side first inverting member 52 to conform to a transport reference registration position (for example, center registration (CR)) of continuous paper 9 in the fixing device 40, as representatively illustrated in FIG. 18.

For example, this is effective for the image forming apparatus 1, for example, when the supply device 11 and the image forming device 2 adopt side registration (SR) different from center registration (CR) as the transport reference registration position of the continuous paper 9, whereas the fixing device 40 adopts center registration (CR). That is, in this case, the transport reference registration position in the supply device 11 and the image forming device 2 does not need to be changed to center registration (CR), but the supply device 11 and the image forming device 2 are combined with the fixing device 40 adopting center registration (CR) only by changing the position of one component (downstream-side first inverting member 52) in the preheating device 5.

In this case, as illustrated in FIG. 18, the downstream-side first inverting member 52 in the preheating device 5 is displaced from an initial position (a position of a first inverting member 52A displaced in the direction of arrow D1) to a conforming position (a position of a first inverting member 52B displaced in the direction of arrow D2).

Thus, when continuous paper 9A transported by side registration (SR) in the supply device 11 and the image forming device 2 passes around the downstream-side first inverting member 52B displaced to the conforming position in the preheating device 5, the continuous paper 9A is sent out as continuous paper 9B in a registration state changed from side registration (SR) to center registration (CR) in the fixing device 40. As a result, the continuous paper 9B changed to center registration (CR) and sent to the fixing device 40 passes through the fixing nip FN while being transported by center registration (CR) in the fixing device 40. Hence, the fixing operation is normally performed. For convenience, a side edge portion 9*c* of the continuous paper 9A transported by side registration (SR) to be regulated is slightly separate from a two-dot chain line representing side registration (SR) in FIG. 18. In practice, however, the continuous paper 9A is transported in a state in which the side edge portion 9*c* extends along (is nearly aligned with) the two-dot chain line representing side registration (SR).

This structure in which the downstream-side first inverting member 52 in the preheating device 5 is displaceable to conform to the transport reference registration position of the continuous paper 9 in the fixing device 40 is similarly applied to the preheating devices 5B to 5E in the second to fifth exemplary embodiments. In the preheating device 5B, the downstream-side first inverting member 56 is provided displaceably to conform to the transport reference registration position of the continuous paper 9 in the fixing device 40. In the preheating devices 5E and 5F, the downstream-side first inverting member 520 is provided displaceably to conform to the transport reference registration position of the continuous paper 9 in the fixing device 40.

In the fixing system 4 according to the first exemplary embodiment (for example, FIG. 2), the relay roller 63 in the inverting device 6 may be structured as a heating roller (for example, a heat source is disposed in an internal space of the roller base of the relay roller 63) as required.

In the fixing system 4B according to the second exemplary embodiment (for example, FIG. 7), the guide roller 71 may also be structured as a heating roller as required.

Further, in the fixing system 4C according to the third exemplary embodiment (for example, FIG. 10), one or both of the structure in which the relay roller 63 in the inverting device 6B serves as a heating roller and the structure in which at least one of the first guide roller 75 and the second guide roller 76 serves as a heating roller may be adopted.

When the other roller is structured as the heating rotating body in addition to the heating rollers 53 or 57 in the preheating device 5 (5B or 5C), as described above, the back surface of the continuous paper 9 may be more accurately and efficiently preheated. On the other hand, if heat exhausted from the added heating rotating body may have an adverse influence in this case, for example, the heating temperature of the added heating rotating body is set to be lower than the heating temperature of the heating rotating body, such as the heating roller 53, in the preheating device 5. The shape of the heating rotating body is not limited to the roller shape, but may be other shapes. For example, the heating rotating body may be a belt-shaped heating rotating body provided with plural support rollers on which a heating belt is stretched. This shape also applies to the guide rotating body such as the guide roller 71.

In the fixing system 4E according to the fifth exemplary embodiment (FIGS. 15 to 17), the tilted second and third heating rollers 530D and 530E in the preheating device 5E may be used as inverting members as required. In this case, the upstream-side first inverting member 510, the first heating roller 530C, and the inverting member (serving as the second heating roller 530D) constitute one preheating device (5Ea), and the other inverting member (serving as the third heating roller 530E), the fourth heating roller 530F, and the downstream-side first inverting member 520 constitute one preheating device (5Eb). For this reason, the preheating device having this structure may be treated as a preheating device (5Ea+5Eb) in which two preheating devices (5Ea and 5Eb) are connected in series.

As the heating rollers (530A to 530F) arranged between the upstream-side first inverting member 510 and the downstream-side first inverting member 520, the two heating rollers (530A and 530B) are provided in the fourth exemplary embodiment, and the four heating rollers (530C to 530F) are provided in the fifth exemplary embodiment. However, three heating rollers or five or more heating rollers may be arranged as required as long as transportation of the continuous paper 9 in the desired state and preheating of the back surface 9*b* of the continuous paper 9 are performed.

Further, while the fixing device 40 of the fixing system 4 include the belt-shaped heating rotating body 41 and the roller-shaped pressurizing rotating body 42, for example, in the first and second exemplary embodiments, a belt-shaped or roller-shaped heating rotating body 41 and a roller-shaped or belt-shaped pressurizing rotating body 42 may be arbitrarily combined as the fixing device 40.

Alternatively, in the image forming apparatus 1, the image forming device 2 may form other multicolor images (the types and number of the image forming units 20 are changed), may form a single-color image (for example, a monochrome image) (only the image forming unit 20K is used), or may form an image without using the intermediate transfer device 30. The supply device 11 and the storage device 16 in the image forming apparatus 1 are not limited to the ones adopting the adjusting mechanisms 13 and 18 used in the first and second exemplary embodiments, and mechanisms using other methods may be adopted. For example, the mechanisms using other methods include a mechanism having a structure in which the transport amount of the continuous paper 9 is adjusted by the transport roller pair 14 in the supply device 11 and the tension applied to the continuous paper 9 is adjusted by driving the transport roller pair 19 in the storage device 16 at a fixed torque. Further alternatively, the image forming apparatus may form an unfixed image made of a material different from the toner.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A preheating device comprising:

two first inverting members disposed at different positions while obliquely intersecting a feeding direction of a continuous recording medium on which an unfixed image is formed, the first inverting members inverting the recording medium by passing a back surface of the recording medium, on which the unfixed image is not formed, therealong before a fixing operation; and at least one heating rotating body disposed at a position further on an outside than a side edge portion of the recording medium in the feeding direction to preheat the recording medium before the fixing operation by passing a portion of the back surface of the recording medium present between the two first inverting members so that the portion of the back surface is wound around the heating rotating body.

2. The preheating device according to claim 1, further comprising:

an inverting mechanism that includes two second inverting members disposed at different positions further on a front side serving as an upstream side in the feeding direction of the recording medium than an upstream-side first inverting member, which is one of the two first inverting members disposed more upstream in the feeding direction of the recording medium, while obliquely intersecting the feeding direction of the recording medium, the two second inverting members inverting the recording medium by passing the back surface of the recording medium therealong, and a relay rotating body disposed at a position further on the outside than a side edge portion of the recording medium in the feeding direction by passing a portion of the back surface of the recording medium present between the two second inverting members so that the portion of the back surface is wound around the relay rotating body.

3. The preheating device according to claim 1, further comprising:

a guide rotating body disposed further on a front side serving as an upstream side in the feeding direction of the recording medium than an upstream-side first inverting member, which is one of the two first inverting members disposed more upstream in the feeding direction of the recording medium, while an axial direction of the guide rotating body orthogonally intersects the feeding direction of the recording medium, the guide rotating body guiding the recording medium in a different direction by passing the back surface of the recording medium so that the back surface is wound around the guide rotating body.

4. A fixing system comprising:

a fixing device that performs a fixing operation of fixing an unfixed image formed on a continuous recording medium by passing the recording medium therethrough; and a preheating device disposed at a position upstream of the fixing device in a feeding direction of the recording medium to preheat, before the fixing operation, a portion of a back surface of the recording medium on which the unfixed image is not formed, wherein the preheating device is constituted by the preheating device according to claim 1.

5. The fixing system according to claim 4, wherein a downstream-side first inverting member, which is one of the two first inverting members disposed more downstream in the feeding direction of the recording medium in the preheating device, is displaceable in a direction allowing the downstream-side first inverting member to conform to a transport reference registration position of the recording medium in the fixing device.

6. An image forming apparatus comprising:

an image forming device that forms an unfixed image on a continuous recording medium; and the fixing system according to claim 4, the fixing system performing the fixing operation of fixing the unfixed image formed on the recording medium in the image forming device after preheating the back surface of the recording medium on which the unfixed image is not formed.

* * * * *